US009103612B2

(12) United States Patent
Foster

(10) Patent No.: US 9,103,612 B2
(45) Date of Patent: Aug. 11, 2015

(54) SHOTGUN AMMUNITION CONVERSION SYSTEM

(71) Applicant: Matthew Jason Foster, Beaverton, OR (US)

(72) Inventor: Matthew Jason Foster, Beaverton, OR (US)

( * ) Notice: Subject to any disclaimer, the term of this patent is extended or adjusted under 35 U.S.C. 154(b) by 0 days.

(21) Appl. No.: 14/196,428

(22) Filed: Mar. 4, 2014

(65) Prior Publication Data

US 2014/0250751 A1 Sep. 11, 2014

Related U.S. Application Data

(60) Provisional application No. 61/773,771, filed on Mar. 6, 2013, provisional application No. 61/774,528, filed on Mar. 7, 2013.

(51) Int. Cl.

| | |
|---|---|
| ***F41A 9/65*** | (2006.01) |
| ***F41A 9/55*** | (2006.01) |
| ***F41A 9/72*** | (2006.01) |
| ***F41C 7/02*** | (2006.01) |

(52) U.S. Cl.

CPC ... *F41A 9/55* (2013.01); *F41A 9/72* (2013.01); *F41C 7/02* (2013.01); *F41A 9/65* (2013.01); *Y10T 29/49947* (2015.01)

(58) Field of Classification Search

CPC ..... F41A 11/02; F41A 99/00; F41A 9/71; F41A 9/55; F41A 9/65; F41A 9/72; F41C 7/02

USPC ..... 42/69.01, 49.02, 49.01, 19, 6, 17, 50, 42/18; 89/197, 33.04, 33.1

See application file for complete search history.

(56) References Cited

U.S. PATENT DOCUMENTS

| | | | | |
|---|---|---|---|---|
| 4,864,758 | A * | 9/1989 | Crossman | 42/18 |
| 5,056,252 | A * | 10/1991 | Velezis | 42/50 |
| 6,032,395 | A * | 3/2000 | Bentley et al. | 42/19 |
| 6,912,806 | B2 * | 7/2005 | Malindretos | 42/17 |
| 8,418,390 | B1 * | 4/2013 | Wright | 42/49.01 |
| 8,667,723 | B2 * | 3/2014 | Bentley et al. | 42/49.01 |
| 8,756,846 | B1 * | 6/2014 | Lemoine | 42/69.01 |
| 2006/0048426 | A1 * | 3/2006 | Crandall | 42/69.01 |

* cited by examiner

*Primary Examiner* — Samir Abdosh
*Assistant Examiner* — John D Cooper
(74) *Attorney, Agent, or Firm* — Bennet K. Langlotz; Langlotz Patent & Trademark Works, Inc.

(57) ABSTRACT

A shotgun ammunition conversion system has a detachable magazine well having a sleeve defining a rectangular passage adapted to removably receive an ammunition magazine, a boss extending forward of the sleeve and at a level above at least a portion of the sleeve, the boss being adapted to be received in the rear aperture of the magazine tube, and a tang extending rearward of the sleeve and defining a tang aperture operable to receive a fastener associated with a shotgun frame to secure the magazine well to the shotgun with the sleeve proximate and aligned with the loading port when the boss is received in the rear aperture of the magazine tube. The boss may have a lower cylindrical surface portion operable to contact a lower portion of the magazine tube adjacent to the rear aperture. The boss may be a cylindrical body.

19 Claims, 24 Drawing Sheets

SHOTGUN AMMUNITION CONVERSION SYSTEM

CROSS-REFERENCE TO RELATED APPLICATIONS

This application claims priority to U.S. Provisional Application Ser. No. 61/773,771 filed Mar. 6, 2013, and entitled "CONVERSION KITS" and to U.S. Provisional Application Ser. No. 61/774,528 filed Mar. 7, 2013, and entitled "CONVERSION KITS."

FIELD OF THE INVENTION

The present invention relates to firearms, and more particularly to a shotgun ammunition conversion system that converts a repeating shotgun into a repeating rifle capable of firing centerfire and rimfire cartridges.

BACKGROUND OF THE INVENTION

A shotgun is a firearm that uses the energy of a shotgun shell to fire a number of small spherical pellets called shot, or a solid projectile called a slug. One popular type of shotgun is the repeating pump-action shotgun. A conventional pump-action shotgun is one in which the handgrip or forend can be pumped back and forth in order to cycle the action to eject a spent round of ammunition and to chamber a fresh one. A pump-action shotgun is typically fed from a tubular magazine underneath the barrel, which also serves as a guide for the movable forend. The rounds are fed one by one into the action through a port in the receiver, where they are lifted by a lever called the shell lifter and are pushed forward into the chamber by the bolt. A pair of interrupters at the rear of the magazine holds the rounds in place to facilitate feeding of one shell at a time.

The forend is connected to the bolt by one or two bars (two bars are considered more reliable because they provide symmetric forces on the bolt and pump and reduce the chances of binding). The motion of the bolt back and forth in a tubular magazine model also operates the shell lifter, which lifts the shells from the level of the magazine to the level of the barrel. Modern pump shotgun designs have a safety feature called a trigger disconnector, which disconnects the trigger from the sear as the bolt moves back, so that the trigger must be released and pulled again to fire the shotgun after it closes.

After firing a round, the bolt is unlocked and the forend is free to move. The shooter pulls back on the forend to begin the operating cycle. The bolt unlocks and begins to move to the rear, which extracts and ejects the empty shell from the chamber, cocks the hammer, and begins to load the new shell. In a tubular magazine design, as the bolt moves rearwards, a single shell is released from the magazine and is pushed backwards to come to rest on the shell lifter.

As the forend reaches the rear and begins to move forward, the shell lifter lifts up the shell, lining it up with the barrel. As the bolt moves forward, the round slides into the chamber, and the final portion of the forend's travel locks the bolt into position. A pull of the trigger will fire the next round, where the cycle begins again.

A shotgun is generally a smoothbore firearm, which means that the inside of the barrel is not rifled. The shot pellets from a shotgun spread upon leaving the barrel, and the power of the burning charge is divided among the pellets, which means that the energy of any one ball of shot is fairly low. Shotguns are very popular for bird hunting. Shotguns can also be used for more general forms of hunting with slugs. Shotguns are often used with rifled barrels in locations where it is not lawful to hunt with a rifle. Typically, a sabot slug is used in these barrels for maximum accuracy and performance. However, the relatively low muzzle velocity of slug ammunition, and the blunt, poorly streamlined shape of typical slugs that causes them to lose velocity very rapidly compared to rifle bullets, limits the effectiveness of shotguns with many types of game.

Therefore, a need exists for a new and improved shotgun ammunition conversion system that converts a repeating shotgun into a repeating rifle capable of firing centerfire and rimfire cartridges. These larger caliber and higher-powered cartridges relative to shotgun shells enable shotgun users to hunt a wider variety of game while in the field without requiring the user to carry two separate guns. In this regard, the various embodiments of the present invention substantially fulfill at least some of these needs. In this respect, the shotgun ammunition conversion system according to the present invention substantially departs from the conventional concepts and designs of the prior art, and in doing so provides an apparatus primarily developed for the purpose of converting a repeating shotgun into a repeating rifle capable of firing centerfire and rimfire cartridges.

SUMMARY OF THE INVENTION

The present invention provides an improved shotgun ammunition conversion system, and overcomes the above-mentioned disadvantages and drawbacks of the prior art. As such, the general purpose of the present invention, which will be described subsequently in greater detail, is to provide an improved shotgun ammunition conversion system that has all the advantages of the prior art mentioned above.

To attain this, the preferred embodiment of the present invention essentially comprises a detachable magazine well having a sleeve defining a rectangular passage adapted to removably receive an ammunition magazine, a boss extending forward of the sleeve and at a level above at least a portion of the sleeve, the boss being adapted to be received in the rear aperture of the host shotgun's magazine tube, and a tang extending rearward of the sleeve and defining a tang aperture operable to receive a fastener associated with a shotgun frame to secure the magazine well to the shotgun with the sleeve proximate and aligned with the loading port when the boss is received in the rear aperture of the magazine tube. The boss may have a lower cylindrical surface portion operable to contact a lower portion of the magazine tube adjacent to the rear aperture. The boss may be a cylindrical body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
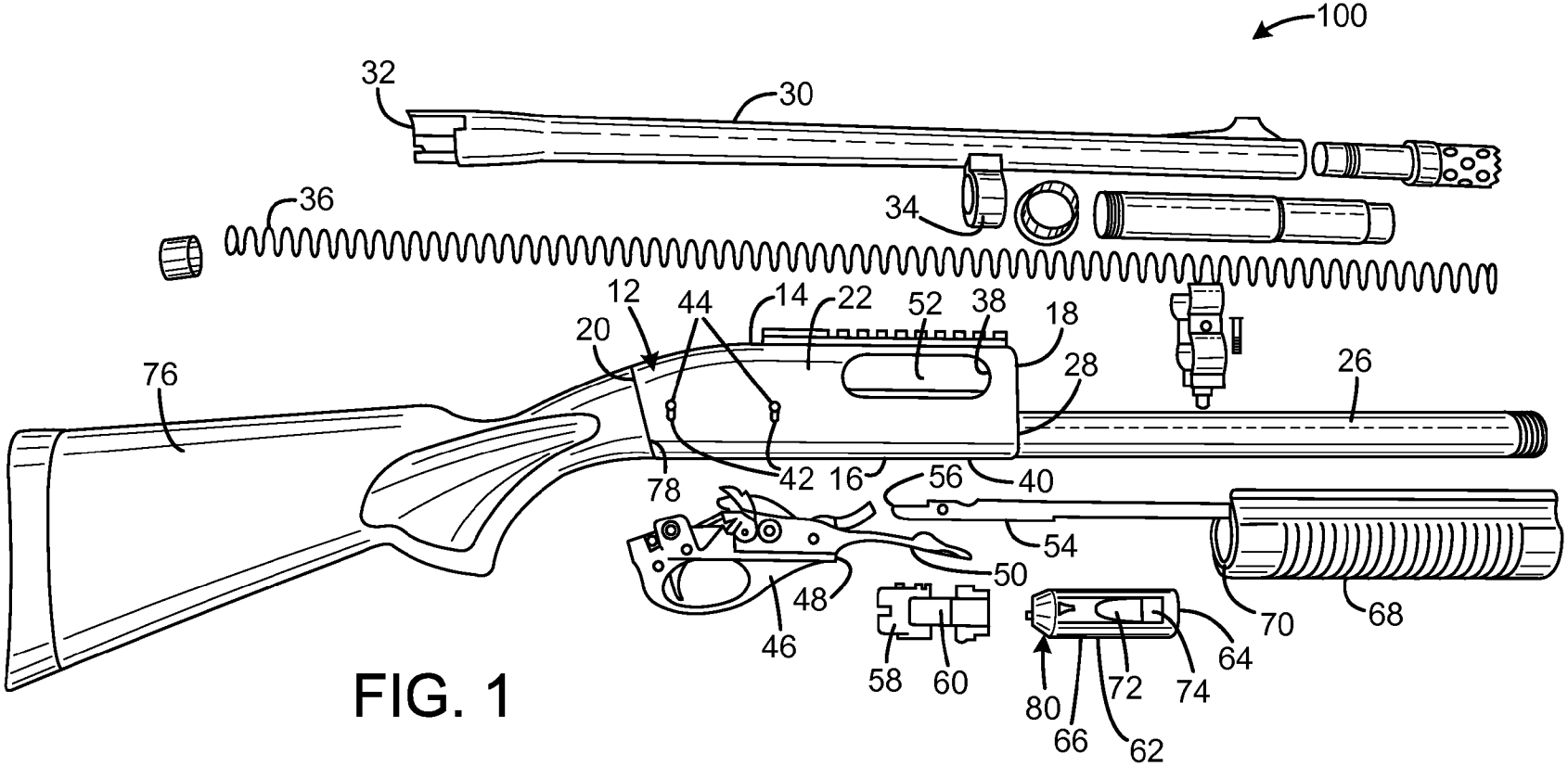
FIG. 1 is a right side view of a prior art pump-action shotgun.

Embodiments of a shotgun conversion system of the present invention are shown and generally designated by the reference numerals 100, 200, 300, 400, 500, 600, and 700.

FIG. 1 illustrates a prior art shotgun 10 suitable for use with the present invention. More particularly, the shotgun is a conventional pump-action repeating shotgun such as the Model 870™ manufactured by Remington Arms Company, LLC of Madison, N.C. and the Mossberg® 500 and Mossberg® 590 manufactured by O.F. Mossberg & Sons, Inc. of North Haven, Conn. The shotgun has a frame or receiver 12 having a top 14, bottom 16, front 18, rear 20, right side 22, and left side 24 (shown in FIG. 7). The right side of the receiver defines an ejection port 38, and the bottom of the receiver defines a loading port 40. The right side of the receiver defines two takedown pin apertures 42 that receive takedown pins 44 to releasably secure a trigger assembly 46 to the bottom of the receiver. A shell lifter 50 is pivotally attached to the front 48 of the trigger assembly by the forwardmost takedown pin 44.

The receiver 12 has an interior 52 in communication with the ejection port 38, loading port 40, and the front 18. The rear 56 of a bolt slide 54 is slidably inserted into the interior of the receiver through the front. A shoe 58 is attached to the rear of the bolt slide. A bolt assembly 80 including a bolt carrier 62 and a bolt 72 is attached to the shoe. The bottom 66 of the bolt carrier is attached to the top 60 of the shoe such that the front 64 of the bolt carrier faces towards the front of the receiver. The bolt carrier has a hollow interior 74 that receives the bolt. The rear 70 of a forend 68 is attached to the bolt slide in front of the bolt assembly. When the forend is pumped forward to chamber a round, the shoe slides forward and pushes a single locking lug upwards to place the bolt into battery.

The rear 28 of a magazine tube 26 and the rear 32 of a barrel 30 are connected to the front 18 of the receiver 12. The barrel has a barrel ring 34 that slides over the magazine tube, indexes the barrel, and holds the barrel in place. A magazine tube spring with follower 36 is received within the magazine tube. The front 78 of a stock 76 is attached to the rear 20 of the receiver.

Figure 2:
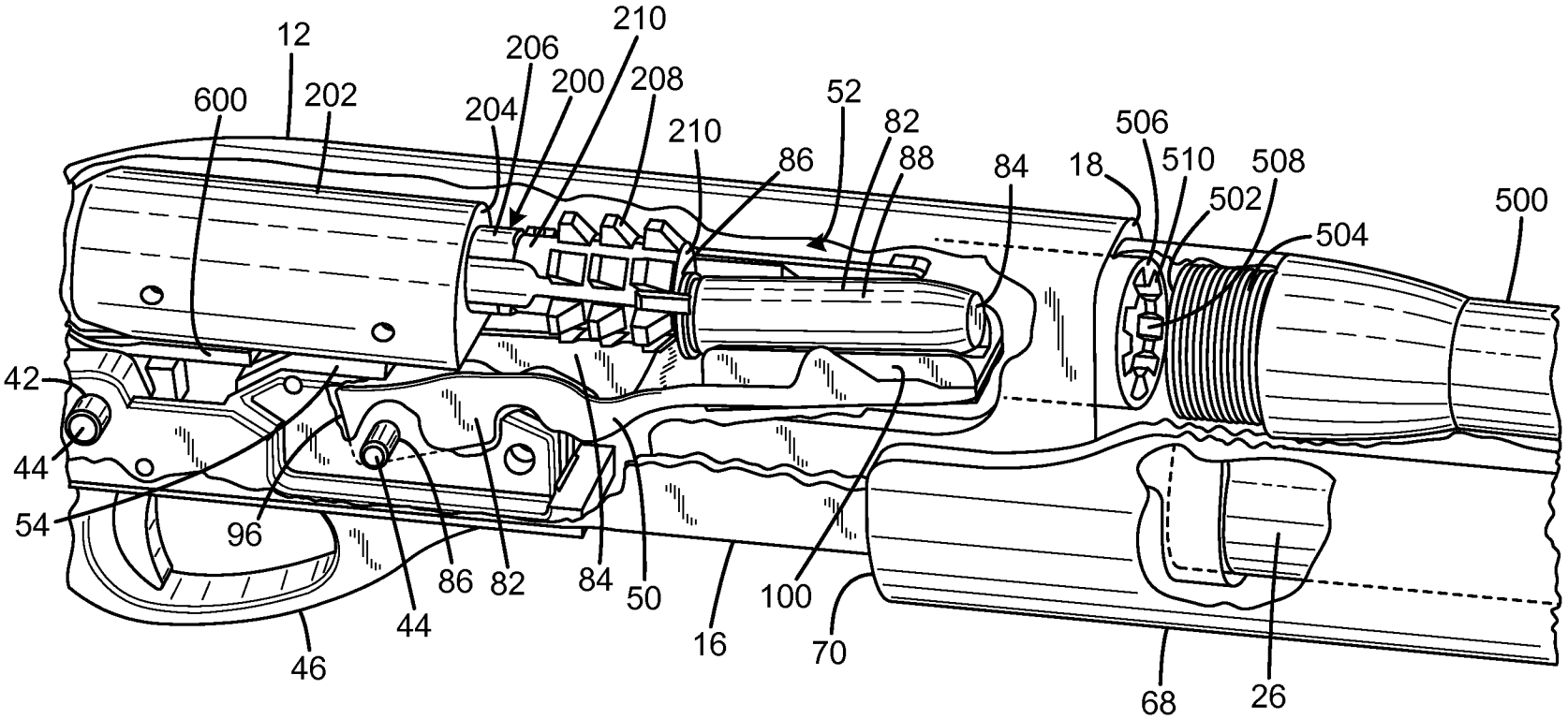
FIG. 2 is an enlarged cutaway view of the current embodiment of a shotgun ammunition conversion system constructed in accordance with the principles of the present invention installed in a receiver of the shotgun of FIG. 1.

FIG. 2 illustrates a shell lifter adapter 100, bolt assembly 200, barrel 500, and shoe 600 of the present invention. More particularly, the shell lifter adapter, bolt assembly, barrel, and shoe convert the repeating shotgun 10 into a repeating rifle capable of firing a rifle cartridge 80 instead of a 12 gauge shotgun shell. The cartridge has a front 84, a rear 86, and an exterior 88. The shell lifter adapter 100, bolt assembly 200, and barrel 500 of the present invention can be adapted to chamber the shotgun to fire any suitable cartridge, including .50 BMG, .300 Win Mag, .308 Winchester, 7.62×39 mm, 5.56×45 mm NATO, and .22 LR, and preferably short action and lever action cartridges. The barrel, bolt assembly, and shoe of the current invention replace the barrel 30, bolt assembly 80, and shoe 58 of the shotgun 10, and the shell lifter adapter attaches to the shell lifter 50, without requiring any modification of the receiver 12.

The rear 502 of the barrel 500 has threads 504 so that a barrel extension 506 can be threadably connected to the barrel. The barrel extension of the current invention has the same exterior dimensions as the barrel 30 of the shotgun 10 where the barrel extension is inserted into the front 18 of the receiver. The centerline of the barrel ring and the centerline of the barrel bore of the current invention will have the same dimension as the shotgun, but both the barrel and barrel ring of the current invention can have different external dimensions from the barrel 30 and barrel ring 34 of the shotgun. The interior surface 510 of the barrel extension defines barrel extension slots 508 that are sized to receive bolt lugs 208 on the exterior 210 of the bolt 206. The front 210 of the bolt protrudes from the front 204 of the bolt carrier 202. The bolt assembly 200 will be described in further detail in the discussion of FIGS. 6-9.

Figure 3:
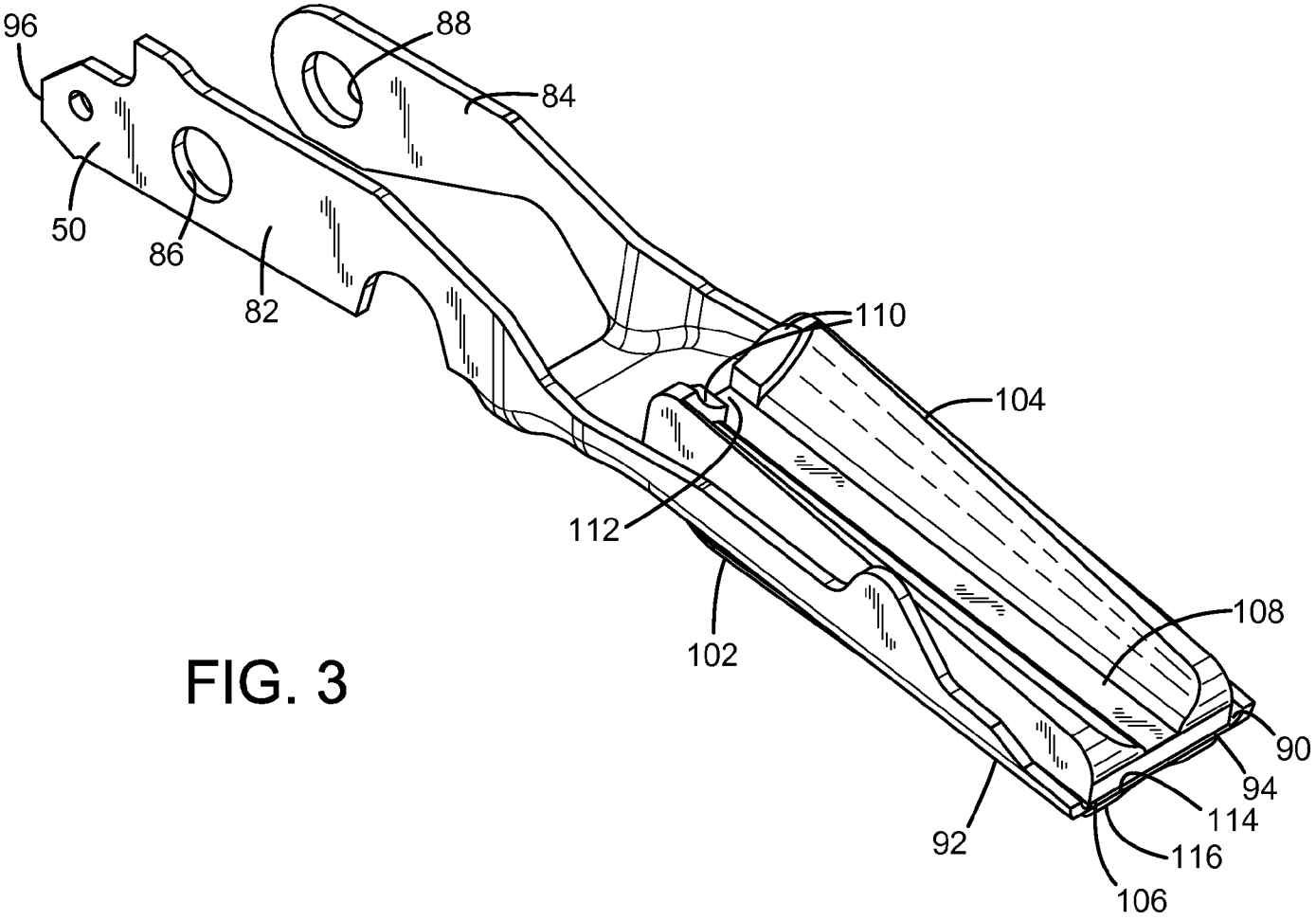
FIG. 3 is a top isometric view of a current embodiment of a shell lifter adapter of the present invention attached to a shell lifter of the shotgun of FIG. 1.
Figure 4:
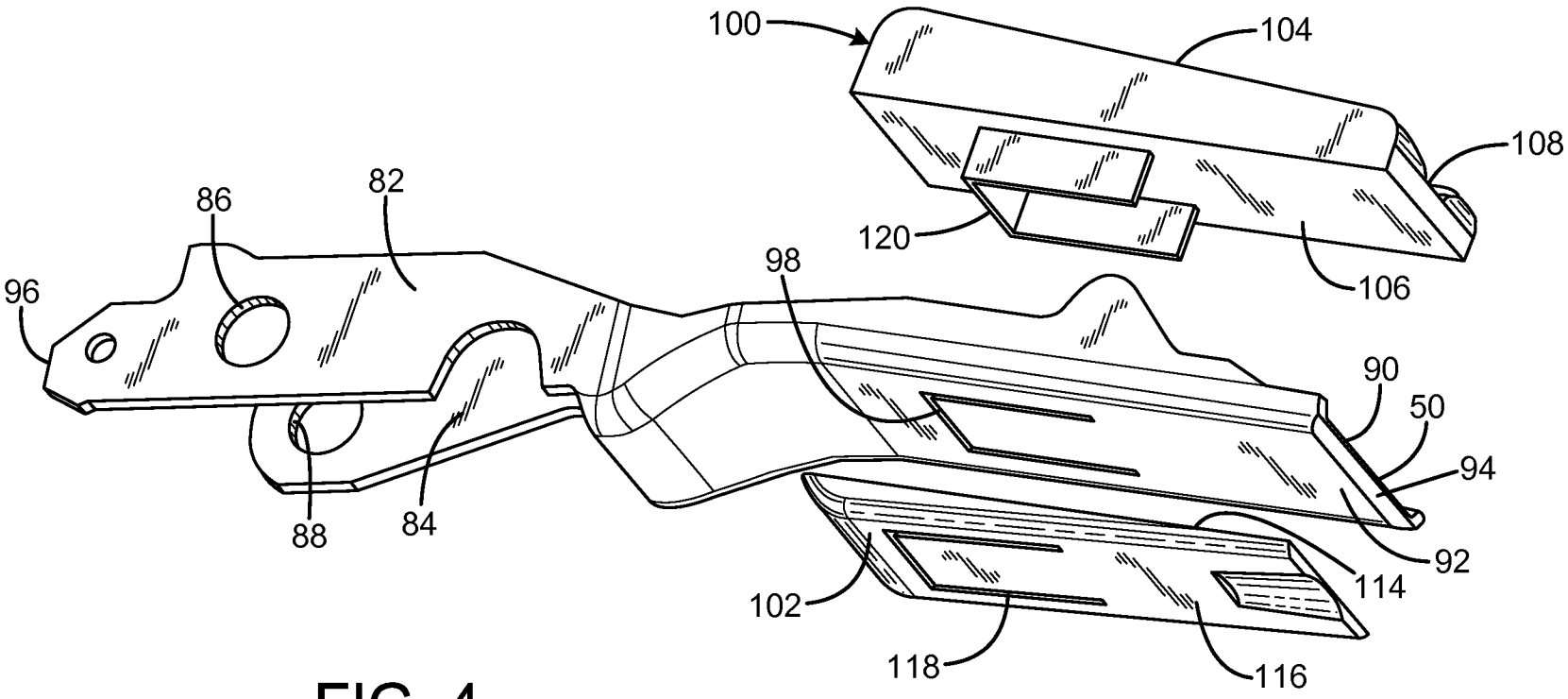
FIG. 4 is an exploded view of the shell lifter adapter of FIG. 3.
Figure 5:
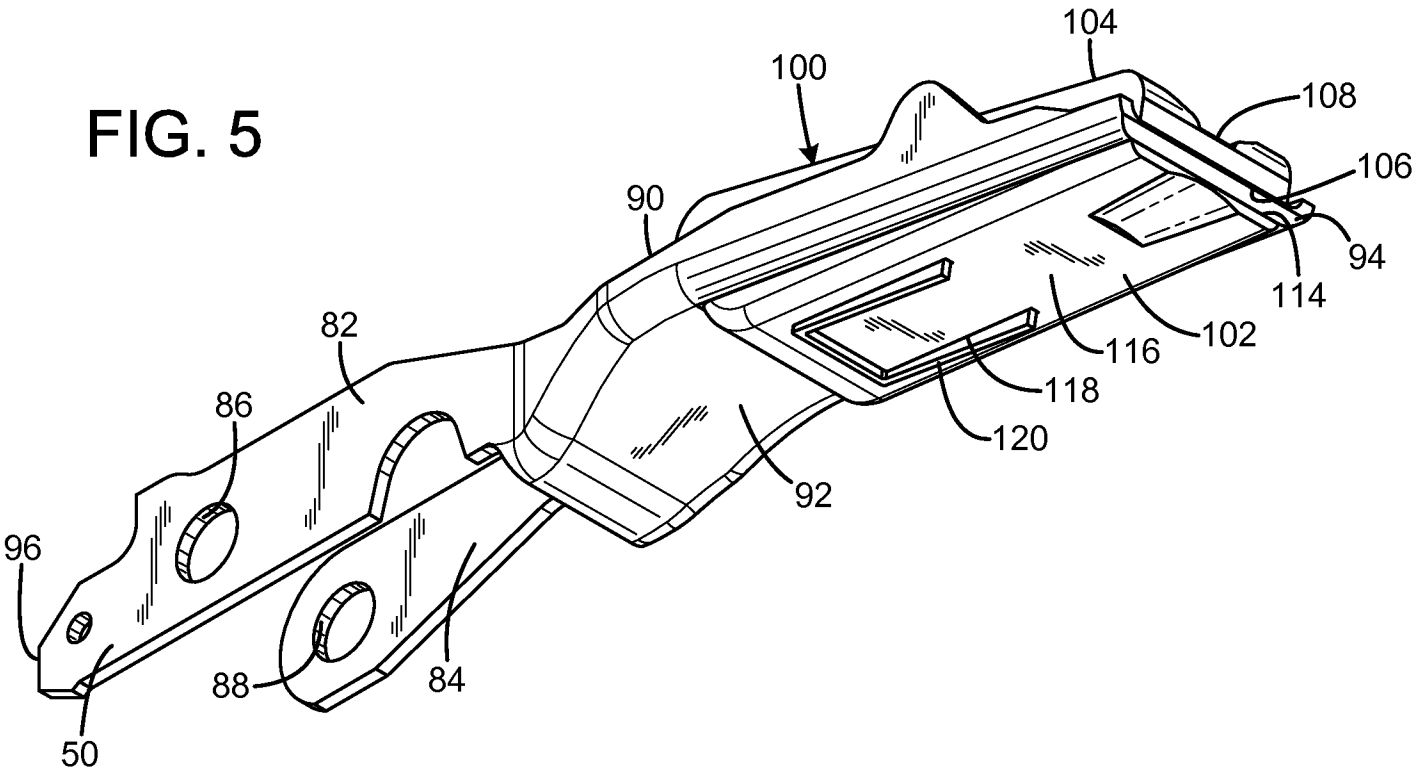
FIG. 5 is a bottom isometric view of the shell lifter adapter of FIG. 3.

FIGS. 3-5 illustrate the shell lifter adapter 100 of the present invention. More particularly, the shell lifter adapter is shown removably attached to the shell lifter 50 of the shotgun 10. The shell lifter 50 has a top 90, bottom 92, front 94, and rear 96. The front of the shell lifter has a U-shaped cutout 98. A right tang 82 and a left tang 84 extend rearwardly. The right and has an aperture 86, and the left tang has an aperture 88. The apertures receive the forwardmost takedown pin 44 to pivotally attach the shell lifter to the trigger assembly 46.

The shell lifter adapter 100 has a top 104 and a bottom 106. The top of the shell lifter adapter defines a groove 108 that terminates in rear flanges 110 that are separated by a gap 112. The gap permits the bolt lug to pass by, yet limits the rearward movement of the cartridge. The groove provides a cradle for the exterior 88 of the cartridge 80. The rear flanges are positioned and shaped to permit the front 210 of the bolt 206 to pass over the top of the shell lifter adapter while still engaging the rear 86 of the cartridge to push the front 84 of the cartridge into the rear 502 of the barrel 500. The top of the shell lifter adapter is shaped to lift the front or bullet end of the cartridge up so that when the bolt slides forward, the bullet end of the cartridge will feed smoothly into the chamber in the rear of the barrel.

As is shown in FIGS. 4 and 5, the shell lifter adapter 100 utilizes the existing U-shaped cutout 98 in the front 94 of the shell lifter 50 to removably attach to the shell lifter. The bottom 106 of the shell lifter adapter has a U-shaped snap/spring 120 that is adapted to closely fit the cutout in the shell lifter. An optional bottom shell lifter adapter 102 has a top 114, a bottom 116, and a U-shaped cutout 118. The cutout in the bottom shell lifter adapter snaps over the portion of the snap/spring that protrudes from the cutout in the shell lifter. The front of the shell lifter is essentially clamped between the bottom 106 of the shell lifter adapter and the top of the bottom shell lifter adapter.

Figure 6:
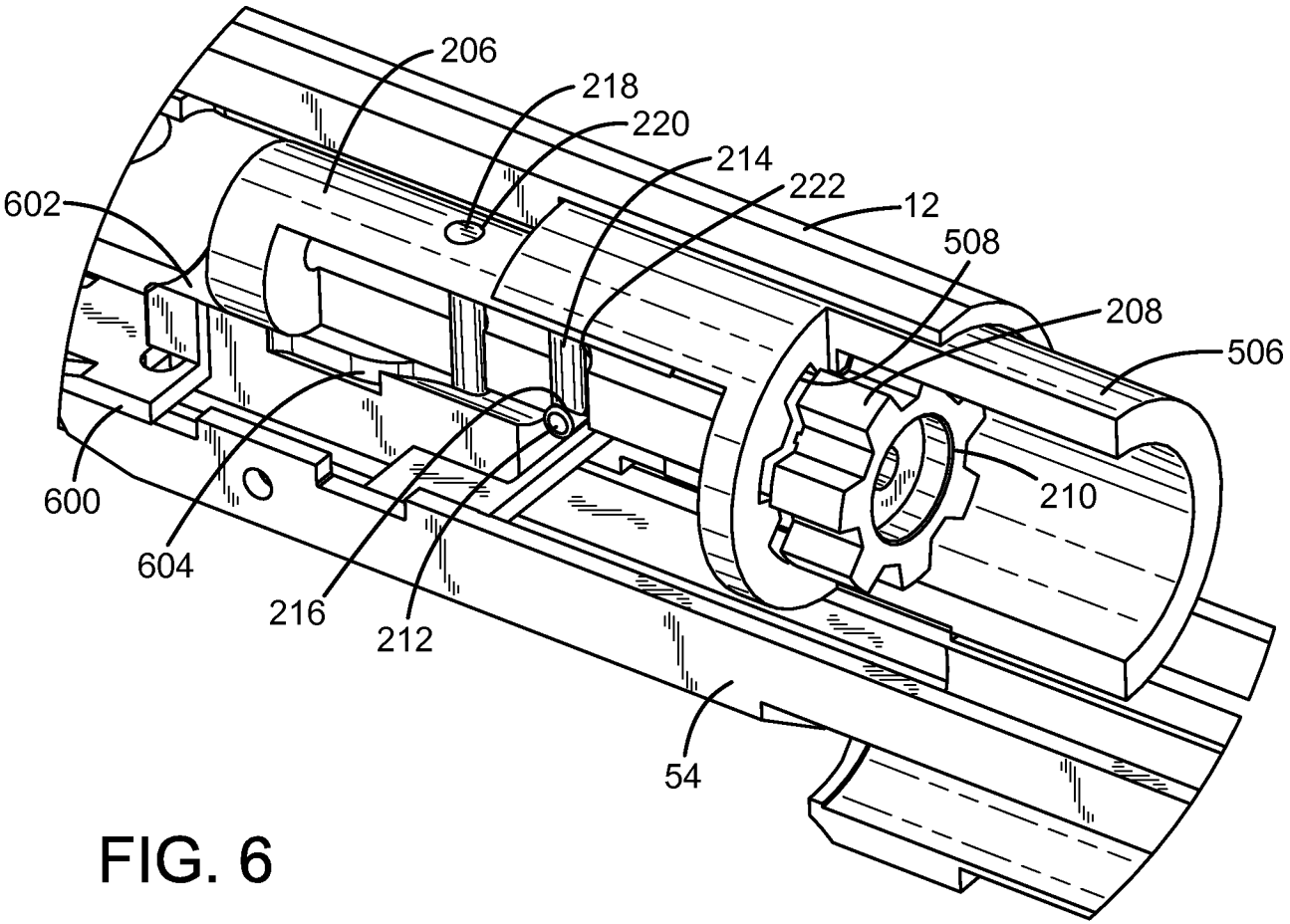
FIG. 6 is an enlarged cutaway right side view of a bolt, shoe, and barrel extension of the present invention installed in a receiver of the shotgun of FIG. 1 in a first position.
Figure 7:
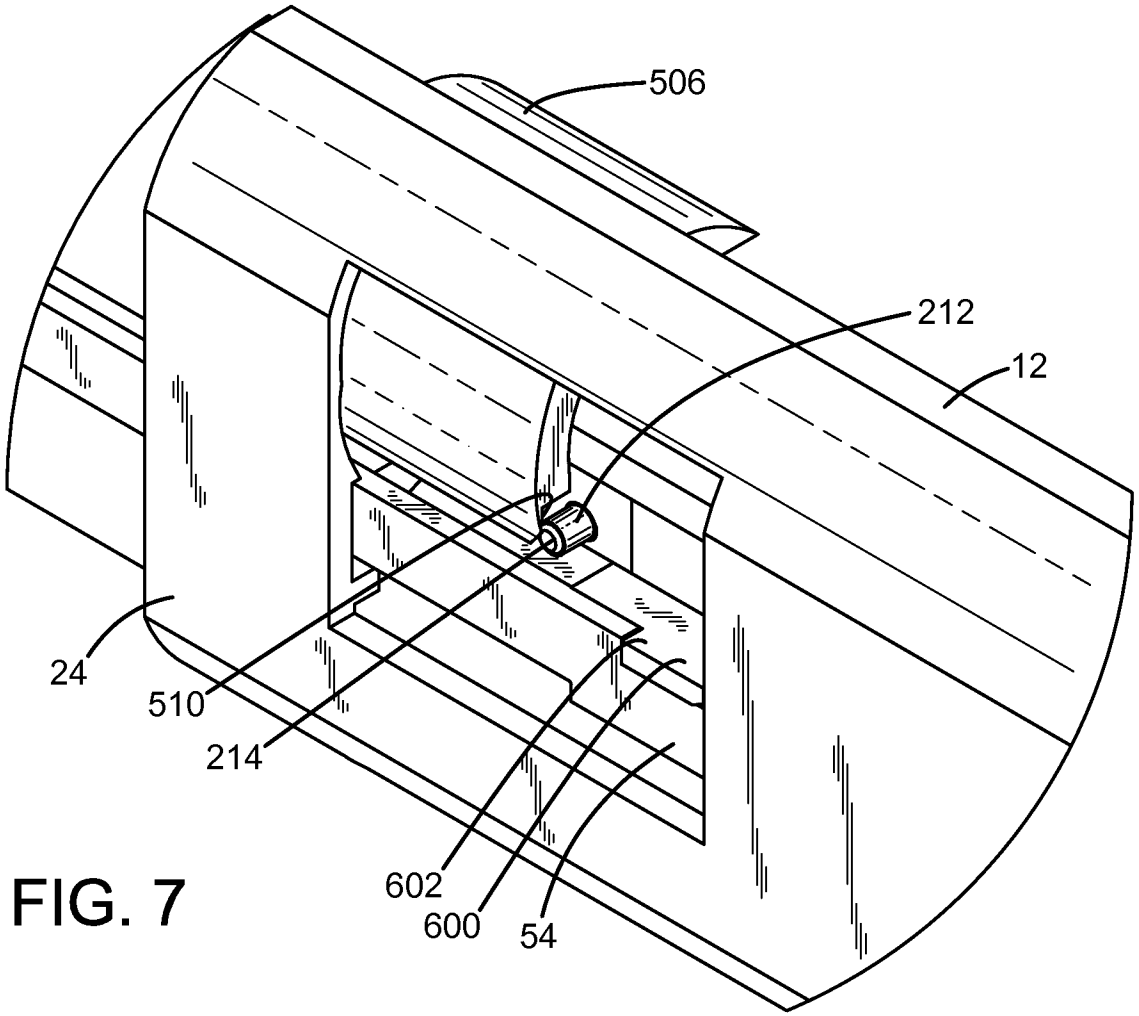
FIG. 7 is an enlarged cutaway left side view of FIG. 6.

FIGS. 6 & 7 illustrate the bolt 206 and shoe 600 of the present invention. More particularly, the bolt carrier 202 is not shown for clarity, and the bolt and shoe are shown in a first position where the rounded head 214 of a locking pin 212 has initially contacted the interior surface 510 of the barrel extension 506 as the forend 68 is moved forwardly. The bolt has a rear bore 220 and a forward bore 222. The rear bore receives a cam pin 218 that has one end that protrudes downward from the rear bore and rides in a helical groove 604 in the top 602 of the shoe 600. The cam pin can also ride in a similar groove in the bolt carrier.

The forward bore 222 receives a cam pin 214 that has one end with a semicircular groove 216 that protrudes downward from the forward bore. The semicircular groove engages a cylindrical locking pin 212 that is received laterally within a bore (not shown) in the bolt carrier. The locking pin has a milled recess or slot 224 (shown in FIG. 8) that is located towards the middle of the locking pin. The slot is sufficiently wide enough to permit passage of the end of the cam pin 214 with the semicircular groove. In the first position, the engagement of the locking pin with the cam pin holds the bolt 206 forward within the bolt carrier. The engagement of the locking pin with the cam pin also keeps the bolt lugs 208 axially registered with the barrel extension slots 508 in the barrel extension 506 so the bolt lugs can pass through the barrel extension slots.

Figure 8:
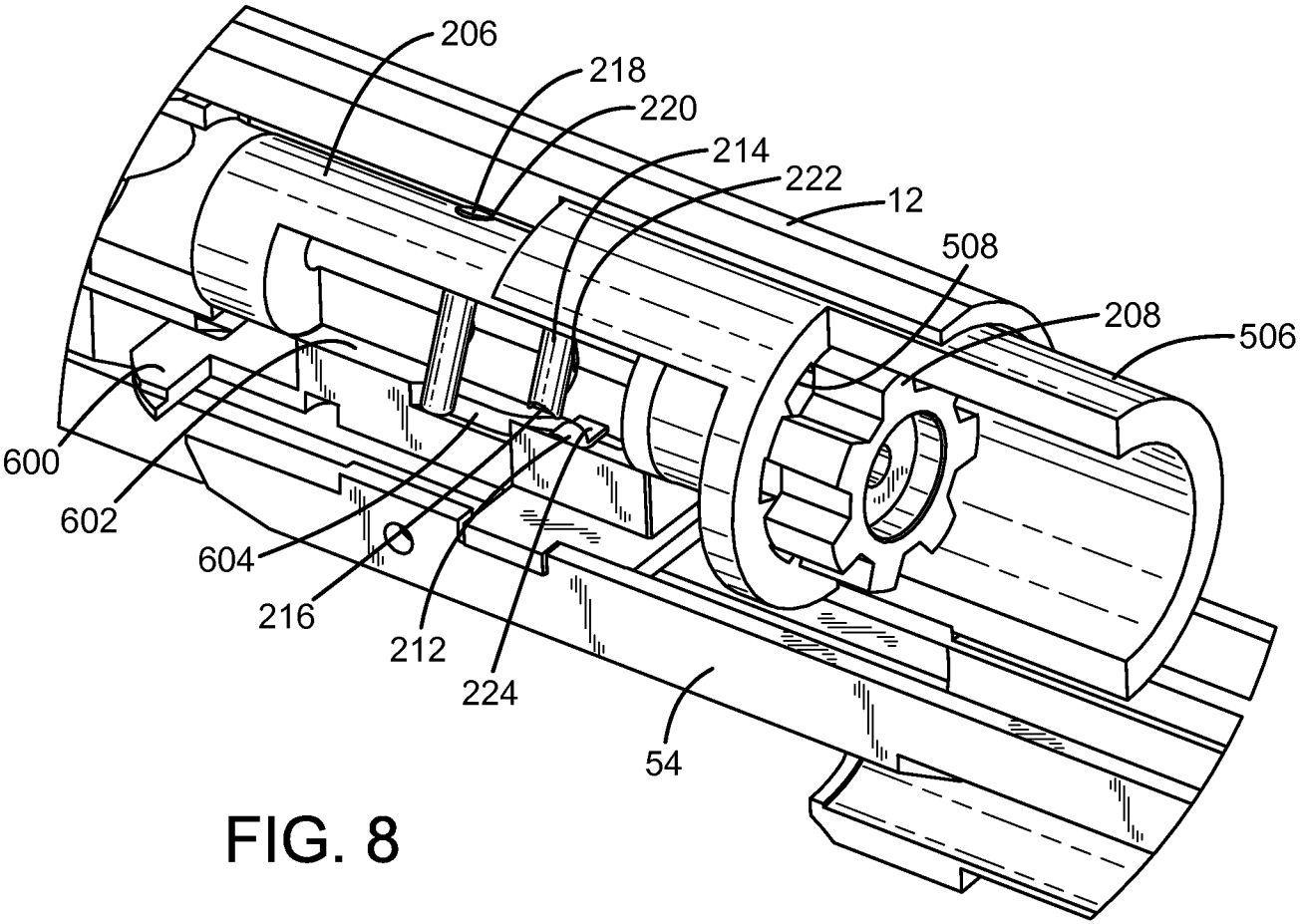
FIG. 8 is an enlarged cutaway right side view of a bolt, shoe, and barrel extension of the present invention installed in a receiver of the shotgun of FIG. 1 in a second position forward of the first position of FIG. 6.
Figure 9:
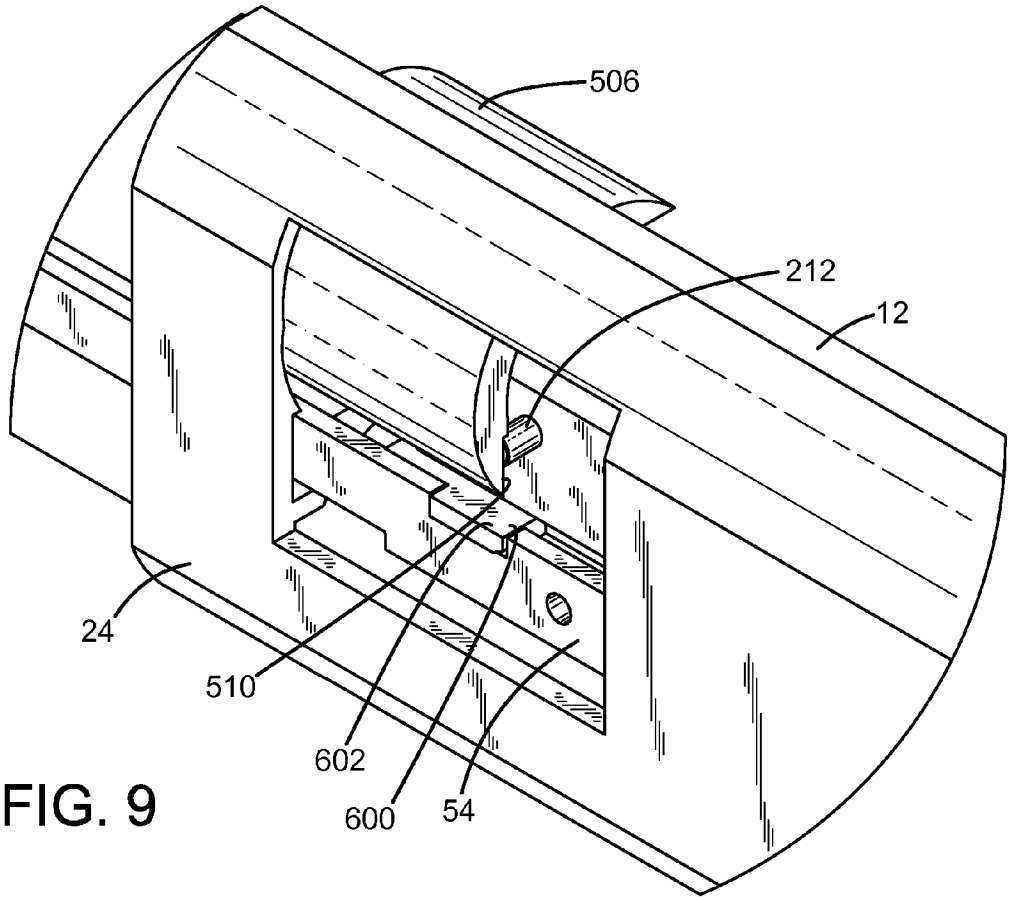
FIG. 9 is an enlarged cutaway left side view of FIG. 8.

FIGS. 8 & 9 illustrate the bolt 206 and shoe 600 of the present invention. More particularly, the bolt carrier 202 is not shown for clarity, and the bolt and shoe are shown in a second position that is forward of the first position described previously with the forend 68 in its forwardmost position. In the second position, the rounded head 214 of the locking pin 212 has been shifted laterally by contact with the interior surface 510 of the barrel extension 506. The slot 224 in the locking pin has shifted laterally so that the slot is axially registered with the end of the cam pin 214 with the semicircular groove 216. Disengagement of the semicircular groove from the locking pin has permitted the shoe 600 and locking pin to move forward relative to the cam pin 214 once the round is chambered and the bolt lugs 208 have passed through the barrel extension slots 508. The continued forward movement of the shoe has caused the cam pin 218 to ride rearwardly in the helical groove 604. As the cam pin rides rearwardly in the helical groove, the cam pin has been forced to rotate, which in turn has forced the bolt to rotate into battery. The rotation of the bolt has altered the relationship between the bolt lugs and the barrel extension slots so that the bolt lugs are no longer axially registered with the barrel extension slots. The bolt cannot move rearwardly until the forend is pulled rearwardly to rotate the bolt and realign the bolt lugs with the barrel extension slots.

Figure 10:
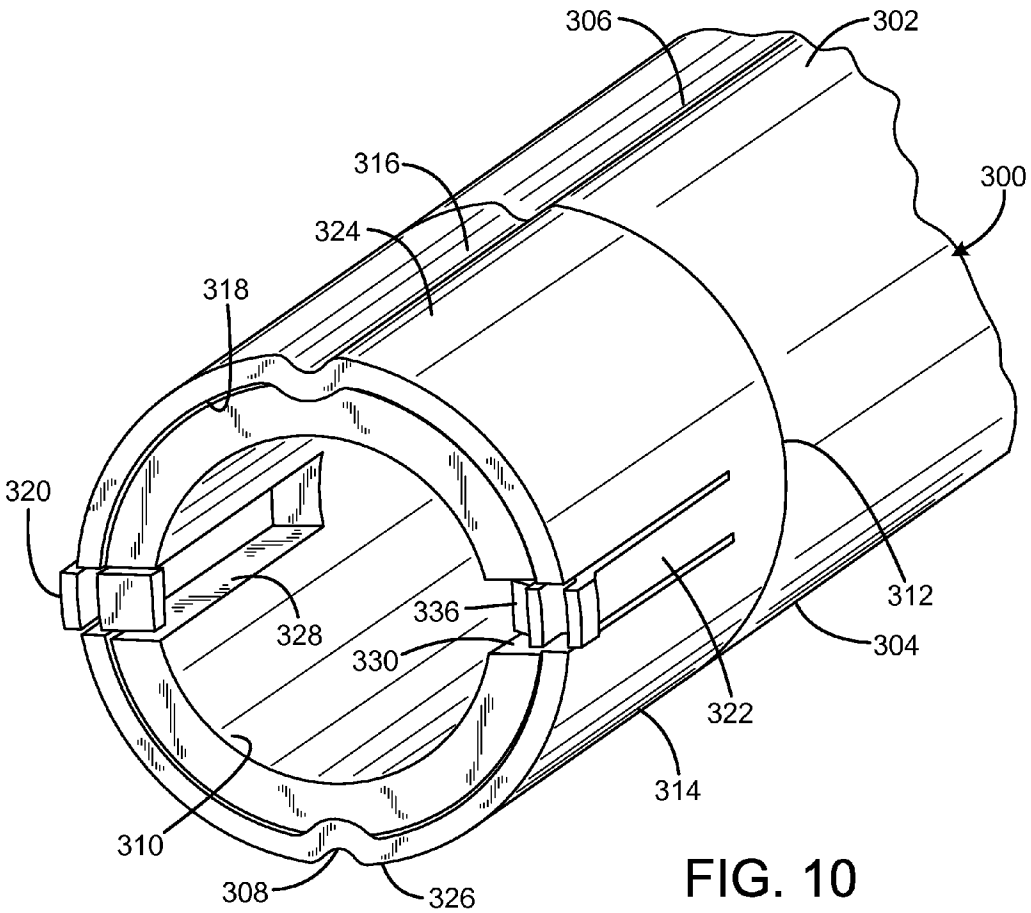
FIG. 10 is a rear isometric partial view of a current embodiment of a magazine tube adapter of the present invention.

FIG. 10 illustrates the magazine tube adapter 300 of the present invention. More particularly, the magazine tube adapter enables the magazine tube 26 of the shotgun 10 to accept cartridges 82 that are smaller than a shotgun shell. The magazine tube adapter has an outer diameter that is sized to be closely received within the magazine tube and a central bore 310. At one end, the magazine tube adapter 300 defines a shoulder 312 that decreases the outer diameter of the magazine tube adapter. The decrease in the outer diameter of the magazine tube adapter at one end permits the installation of a collar 314 with a central bore 318 without enlarging the outer diameter of the magazine tube adapter at that end. The magazine tube adapter has slots (slot 306 is shown) at the top 302 and bottom 304. The collar has slots 316 and 308 at the top 324 and bottom 326. The slots in the magazine tube adapter and the collar are contiguous and enable the magazine tube adapter to be inserted into the magazine tube and clear the detents therein. The magazine tube adapter has a left slot 328 and a right slot 330 that are aligned with a left interrupter 320 and a right interrupter 322 formed in the collar. In the current embodiment, the left and right interrupters are generally shaped like a lowercase H, and the right interrupter has an inward protrusion 336. The function of the left and right interrupters will be described subsequently in the description of FIGS. 11-16. In the current embodiment, the magazine tube adapter is made of plastic and the collar is made of spring steel.

Figure 11:
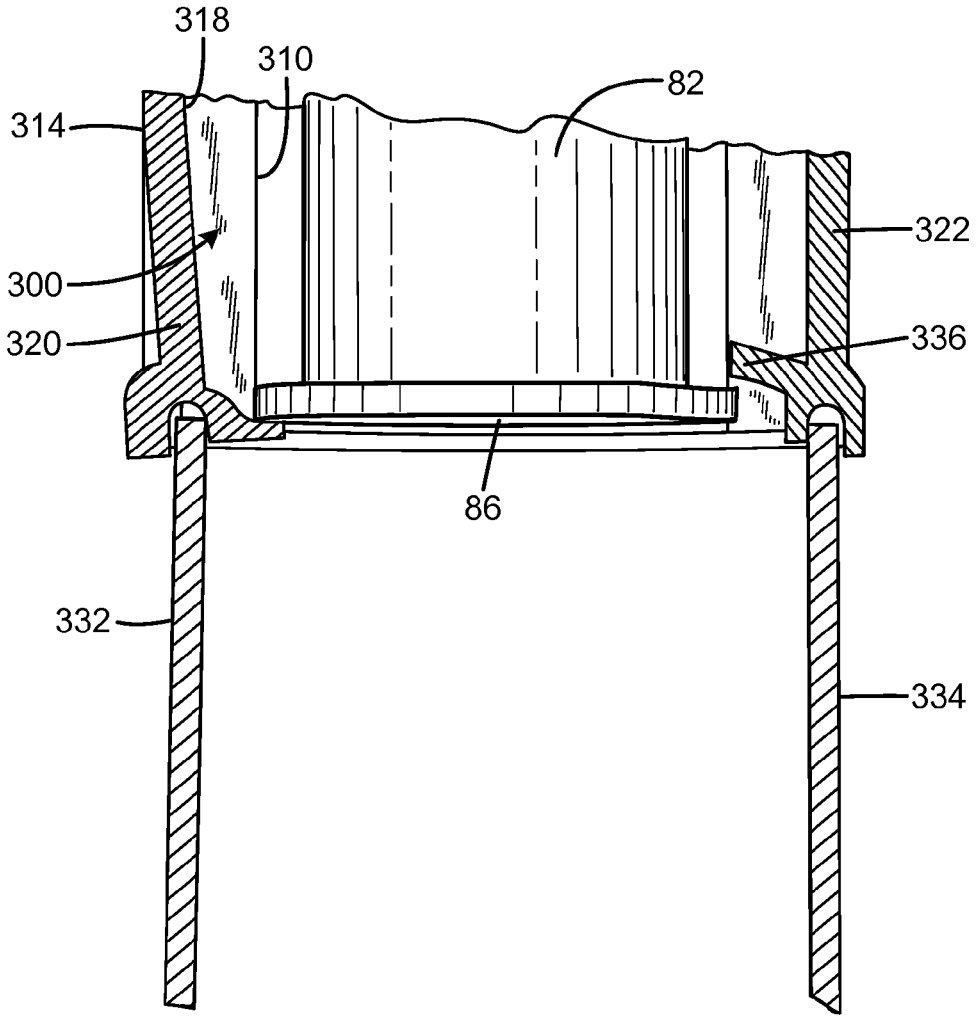
FIG. 11 is a top enlarged sectional view of the magazine tube adapter of FIG. 11 with the forend of the shotgun of FIG. 1 in the forwardmost position.

FIGS. 11-16 illustrate the magazine tube adapter 300 of the present invention. More particularly, the interaction of the left and right interrupters 320, 322 formed in the collar 314 of the magazine tube adapter with the left magazine tube interrupter 332 and right magazine tube interrupter 334 in the receiver 12 of the shotgun 10 is shown. In FIG. 11, the forend 68 is in the forwardmost position. The rearmost cartridge 82 is retained within the central bore 310 of the magazine tube adapter by the left interrupter 320. The left interrupter 320 is pulled inwardly by the left magazine tube interrupter 332.

Figure 12:
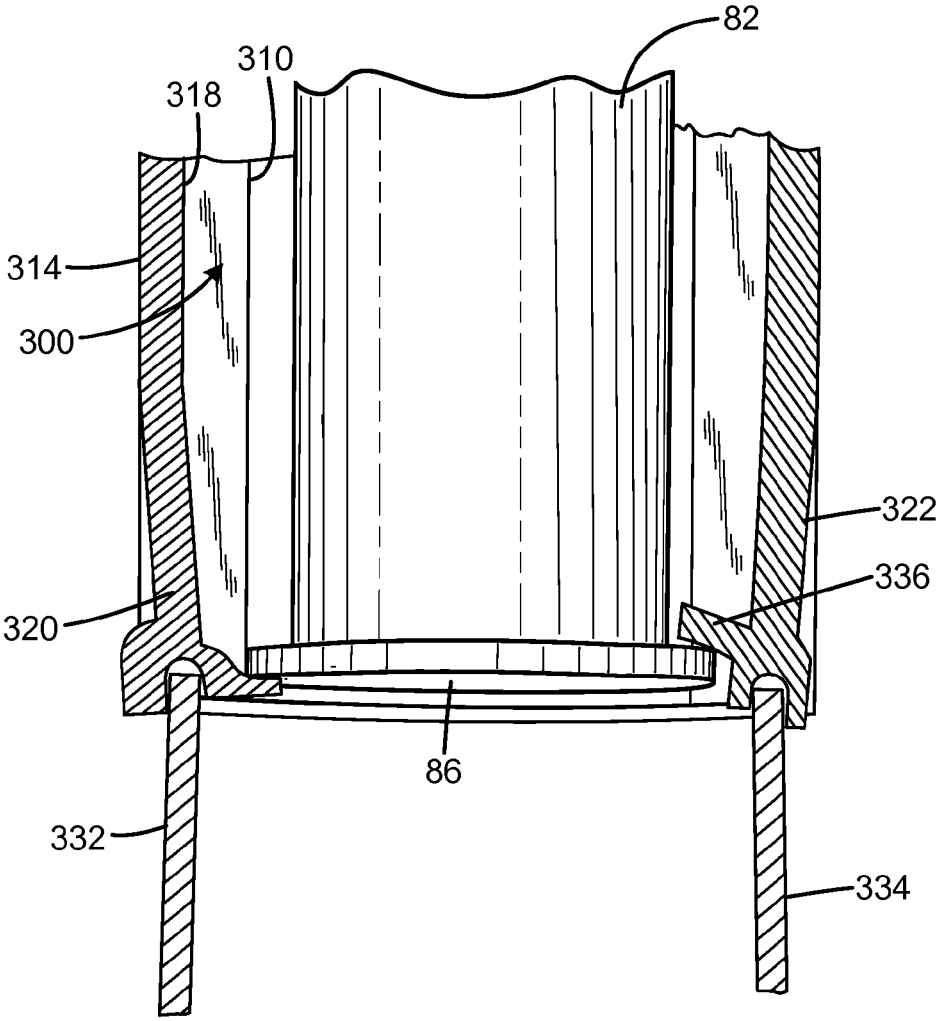
FIG. 12 is a top enlarged sectional view of the magazine tube adapter of FIG. 11 with the forend of the shotgun of FIG. 1 in the halfway retracted position.
Figure 13:
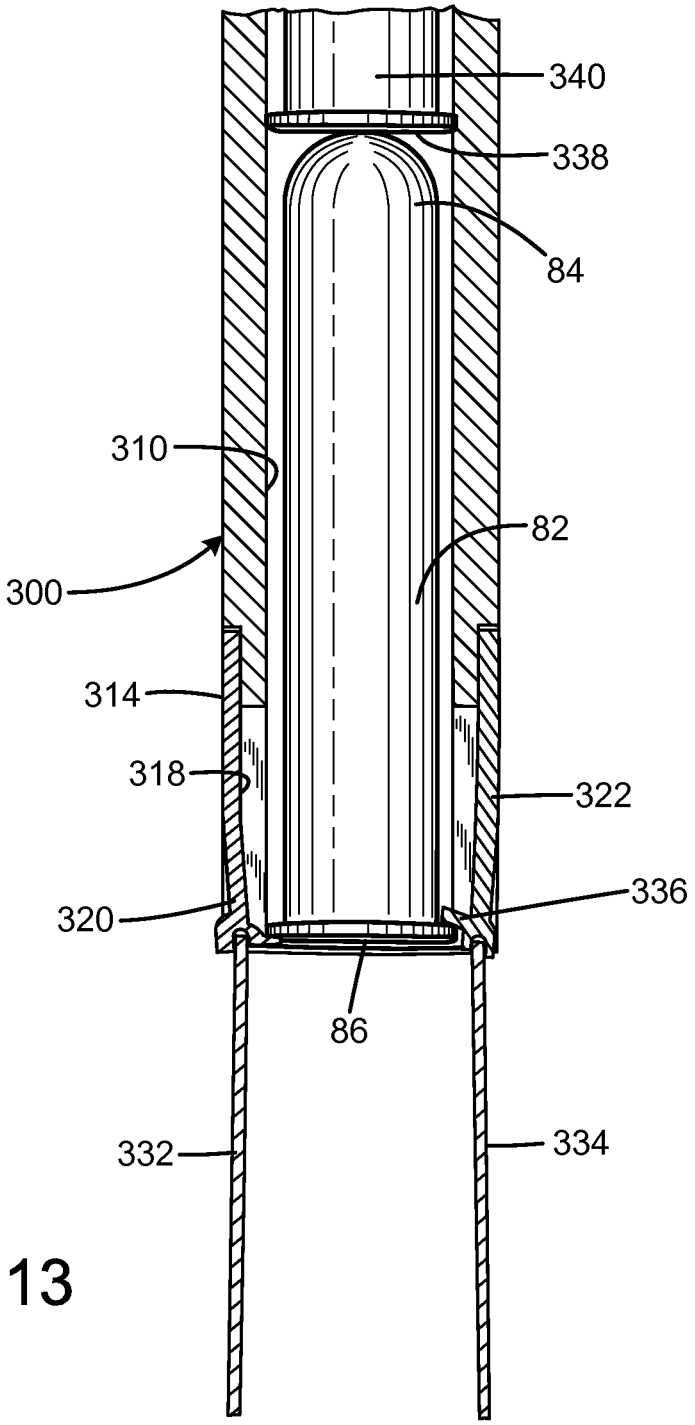
FIG. 13 is a top partial sectional view of the magazine tube adapter of FIG. 12.

In FIGS. 12 & 13, the forend 68 is half retracted. The rearmost cartridge 82 continues to be held in place by the left interrupter 320. However, the right magazine tube interrupter 334 has begun to pull the right interrupter 322 inwardly. The rear 338 of the next cartridge 340 is shown abutting the front 84 of the rearmost cartridge 82.

Figure 14:
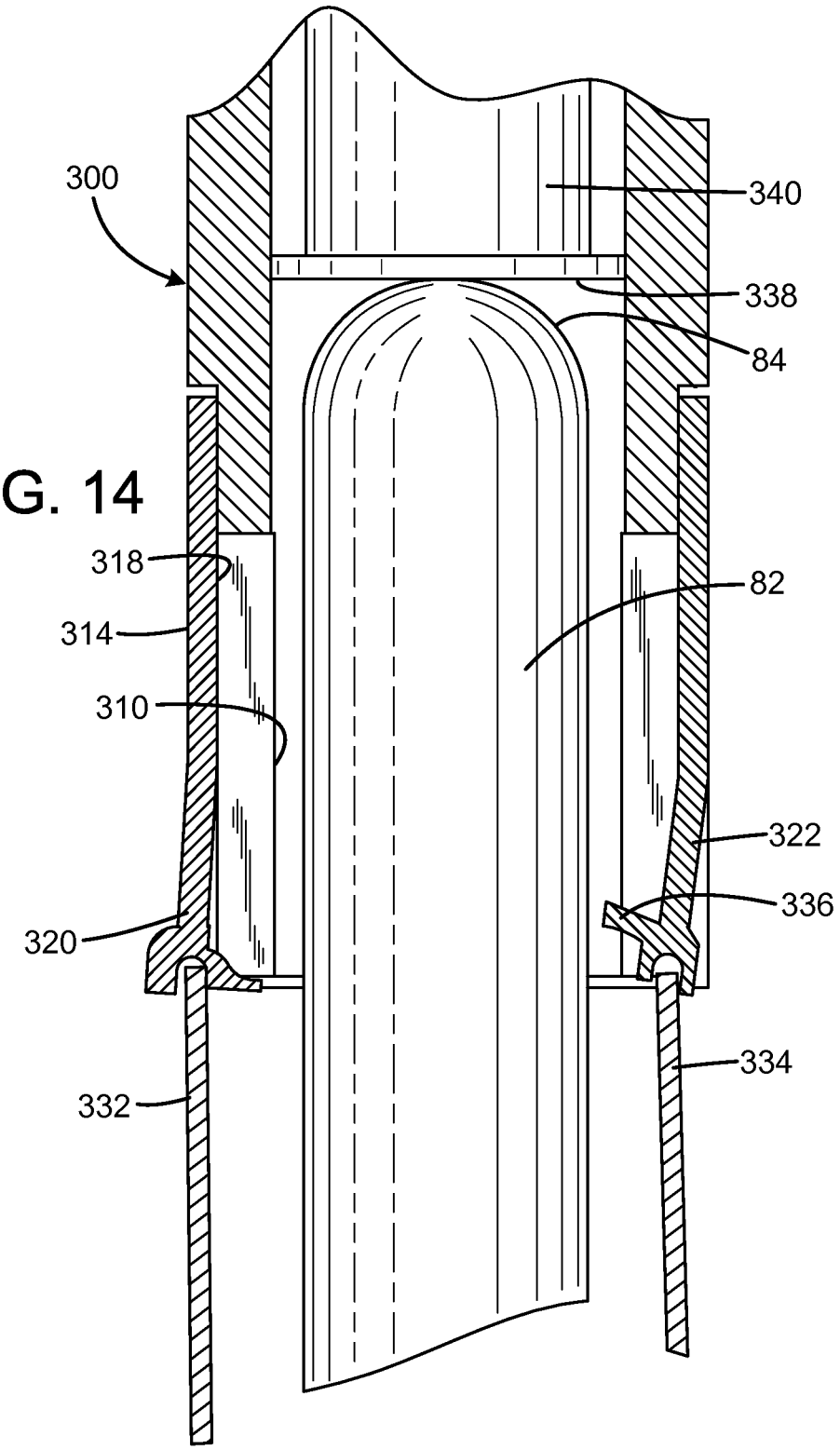
FIG. 14 is a top enlarged sectional view of the magazine tube adapter of FIG. 11 with the forend of the shotgun of FIG. 1 in the rearwardmost position with the rearmost cartridge partially pushed onto the shell lifter adapter of FIG. 3.

In FIG. 14, the forend 68 is fully retracted into the rearmost position. The left magazine tube interrupter 332 has pulled the left interrupter 320 outwardly, thereby disengaging the left interrupter from the rear 86 of the rearmost cartridge 82. Disengagement of the left interrupter from the rear of the rearmost cartridge has permitted the magazine tube spring with follower 36 to begin to urge the rearmost cartridge rearward onto the shell lifter adapter 100 on the shell lifter 50. The right magazine tube interrupter 334 has further pulled the right interrupter 322 inwardly so that the inward protrusion 336 on the right interrupter can engage with the rear 338 of the next cartridge 340 to retain the next cartridge within the magazine tube adapter 300.

Figure 15:
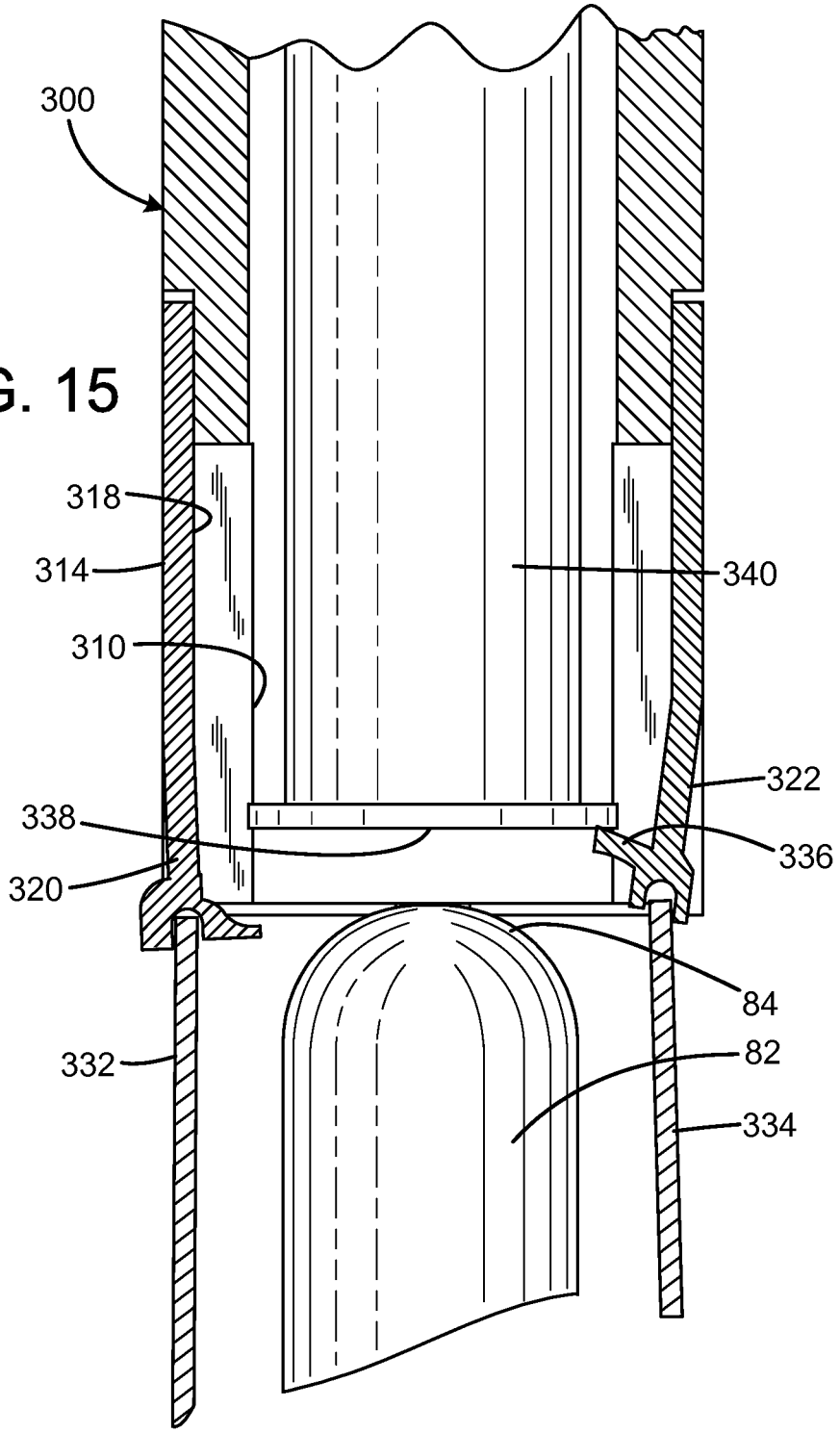
FIG. 15 is a top enlarged sectional view of the magazine tube adapter of FIG. 11 with the forend of the shotgun of FIG. 1 in the rearwardmost position with the rearmost cartridge fully pushed onto the shell lifter adapter of FIG. 3.

In FIG. 15, the forend 68 is still fully retracted into the rearmost position. The left magazine tube interrupter 332 has pulled the left interrupter 320 outwardly, thereby disengaging the left interrupter from the rear 86 of the rearmost cartridge 82. Disengagement of the left interrupter from the rear of the rearmost cartridge has permitted the magazine tube spring with follower 36 to push the rearmost cartridge rearward fully out of the magazine tube adapter 300 and onto the shell lifter adapter 100 on the shell lifter 50. The magazine tube spring with follower has also pushed the rear 338 of the next cartridge 340 into engagement with the inward protrusion 336 on the right interrupter 322.

Figure 16:
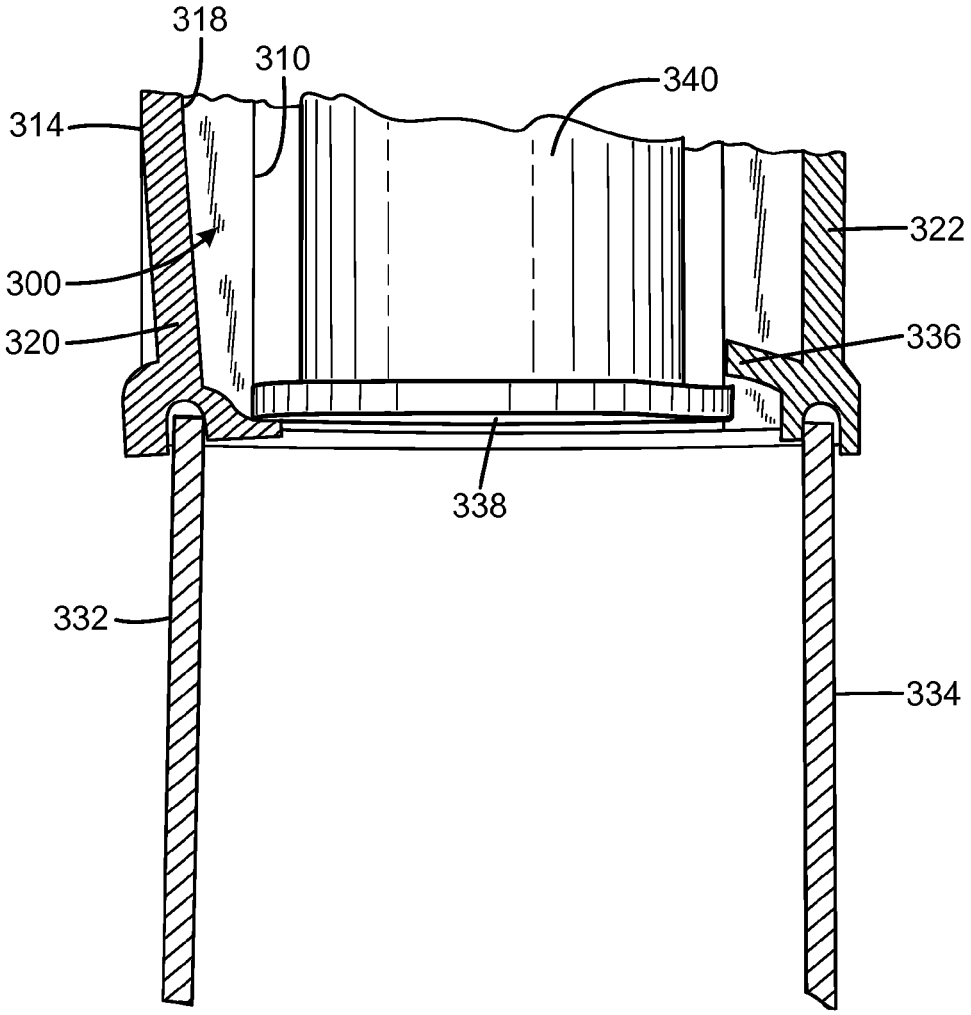
FIG. 16 is a top enlarged sectional view of the magazine tube adapter of FIG. 11 with the forend of the shotgun of FIG. 1 returned to the forwardmost position.

In FIG. 16, the forend 68 has returned to the forwardmost position depicted in FIG. 11. The right magazine tube interrupter 334 has pulled the right interrupter 322 outwardly to disengage the inward protrusion 336 on the right interrupter from the rear 338 of the next cartridge 340. Simultaneously, the left magazine tube interrupter 332 has pulled the left interrupter 320 inwardly so the next cartridge 340 is retained within the central bore 310 of the magazine tube adapter by the left interrupter. As the interrupters move, the magazine tube spring with follower 36 urges the next cartridge rearwardly once the right interrupter has disengaged from the rear of the next cartridge. The cycle can then repeat.

Figure 17:
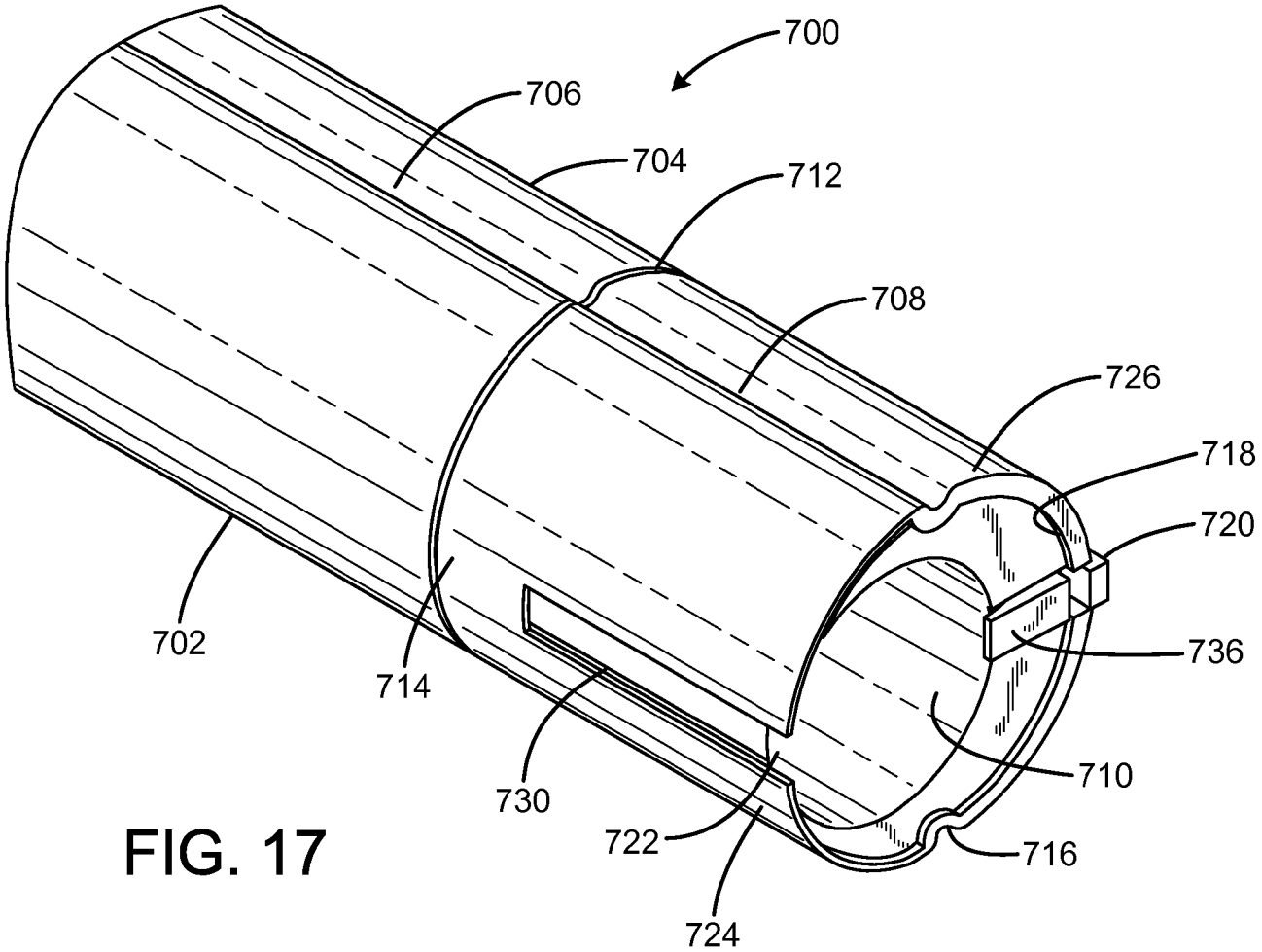
FIG. 17 is a rear isometric partial view of an alternative embodiment of a magazine tube adapter of the present invention.

FIG. 17 illustrates an alternative embodiment of the magazine tube adapter 700 of the present invention. More particularly, the magazine tube adapter enables the magazine tube 26 of the shotgun 10 to accept cartridges 82 that are smaller than a shotgun shell. The magazine tube adapter has an outer diameter that is sized to be closely received within the magazine tube and an asymmetrical bore 710 that is preferably shifted to the left of center so the left magazine tube interrupter 332 can directly engage the rearmost cartridge. However, the asymmetrical bore can also be shifted to the right of center so the right magazine tube interrupter 334 can directly engage the rearmost cartridge. At one end, the magazine tube adapter 700 defines a shoulder 712 that decreases the outer diameter of the magazine tube adapter. The decrease in the outer diameter of the magazine tube adapter at one end permits the installation of a collar 714 with a central bore 718 without enlarging the outer diameter of the magazine tube adapter at that end. The magazine tube adapter has slots (slot 706 is shown) at the bottom 702 and top 704. The collar has slots 716 and 708 at the bottom 724 and top 726. The slots in the magazine tube adapter and the collar are contiguous and enable the magazine tube adapter to be inserted into the magazine tube and clear the detents therein. The magazine tube adapter has a right slot 728 (shown in FIG. 18) and a left slot 730 that are aligned with a right interrupter 720 and a left slot 722 formed in the collar. In the current embodiment, the right interrupter is generally shaped like a lowercase H and has an inward protrusion 736. The function of the right interrupter and the left slot 722 will be described subsequently in the description of FIGS. 18-21. In the current embodiment, the magazine tube adapter is made of plastic and the collar is made of spring steel.

Figure 18:
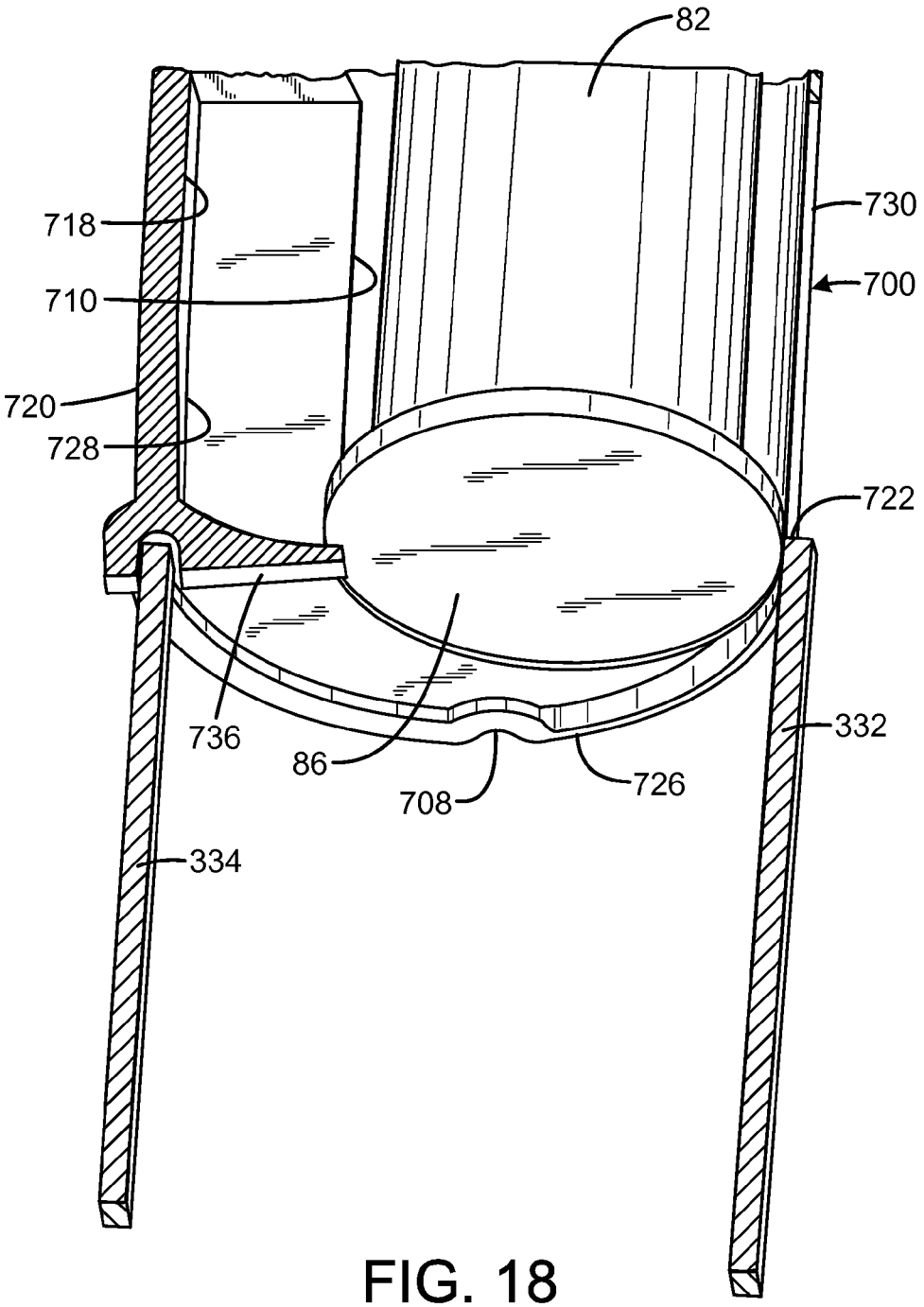
FIG. 18 is a bottom enlarged sectional view of the magazine tube adapter of FIG. 17 with the forend of the shotgun of FIG. 1 in the forwardmost position.

FIGS. 18-21 illustrate the alternative embodiment of the magazine tube adapter 700 of the present invention. More particularly, the interaction of the right interrupter 720 formed in the collar 714 of the magazine tube adapter with the right magazine tube interrupter 334 and left magazine tube interrupter 332 in the receiver 12 of the shotgun 10 is shown. In FIG. 18, the forend 68 is in the forwardmost position. The rearmost cartridge 82 is retained within the asymmetrical bore 710 of the magazine tube adapter by the right interrupter 720. The right interrupter is pulled inwardly by the right magazine tube interrupter 334.

Figure 19:
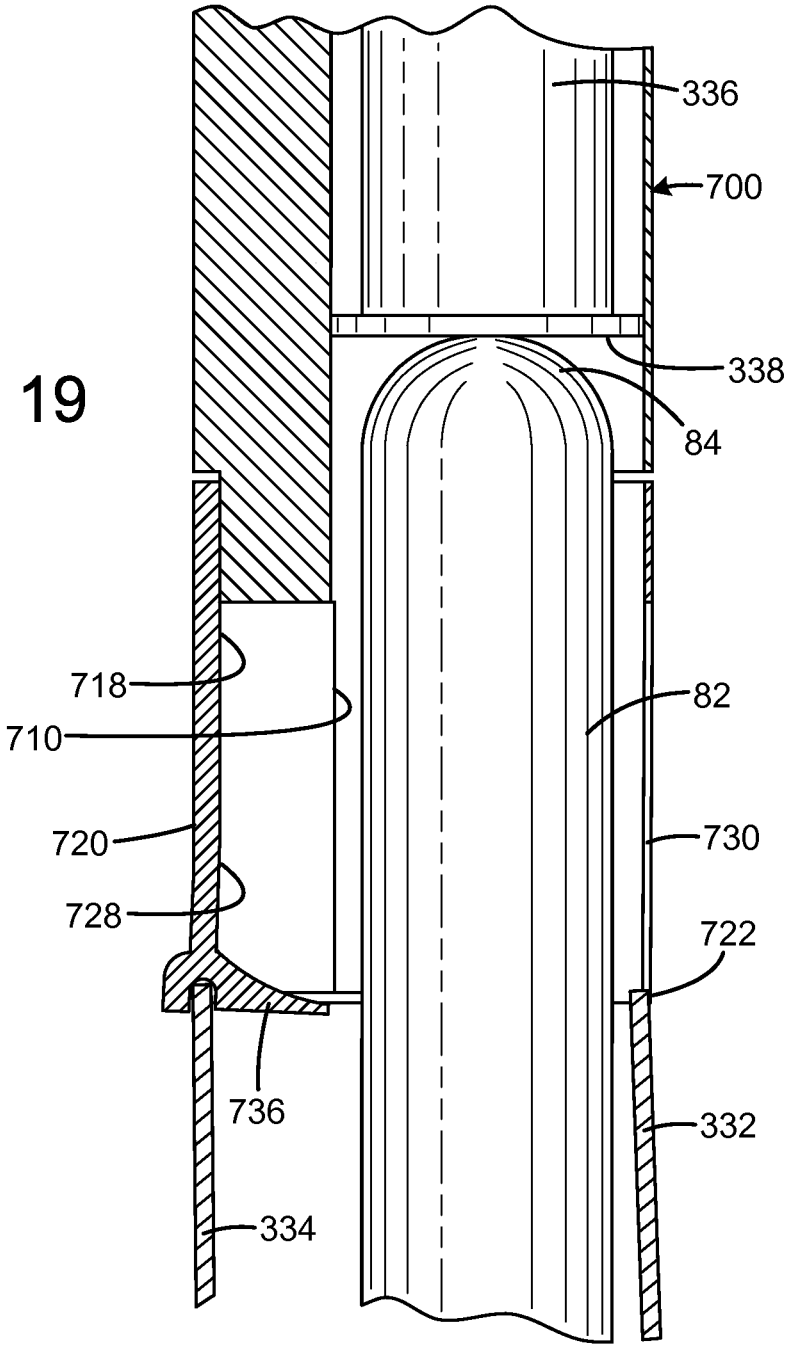
FIG. 19 is a bottom enlarged sectional view of the magazine tube adapter of FIG. 17 with the forend of the shotgun of FIG. 1 in the rearwardmost position with the rearmost cartridge partially pushed onto the shell lifter adapter of FIG. 3.

In FIG. 19, the forend 68 is fully retracted into the rearmost position. The right magazine tube interrupter 334 has pulled the right interrupter 720 outwardly, thereby disengaging the right interrupter from the rear 86 of the rearmost cartridge 82. Disengagement of the right interrupter from the rear of the rearmost cartridge has permitted the magazine tube spring with follower 36 to begin to urge the rearmost cartridge rearward onto the shell lifter adapter 100 on the shell lifter 50. The left magazine tube interrupter 332 has moved inwardly through the left slot 722 so that the left magazine tube interrupter can engage with the rear 338 of the next cartridge 340 to retain the next cartridge within the magazine tube adapter 300. The rear 338 of the next cartridge 340 is shown abutting the front 84 of the rearmost cartridge 82.

Figure 20:
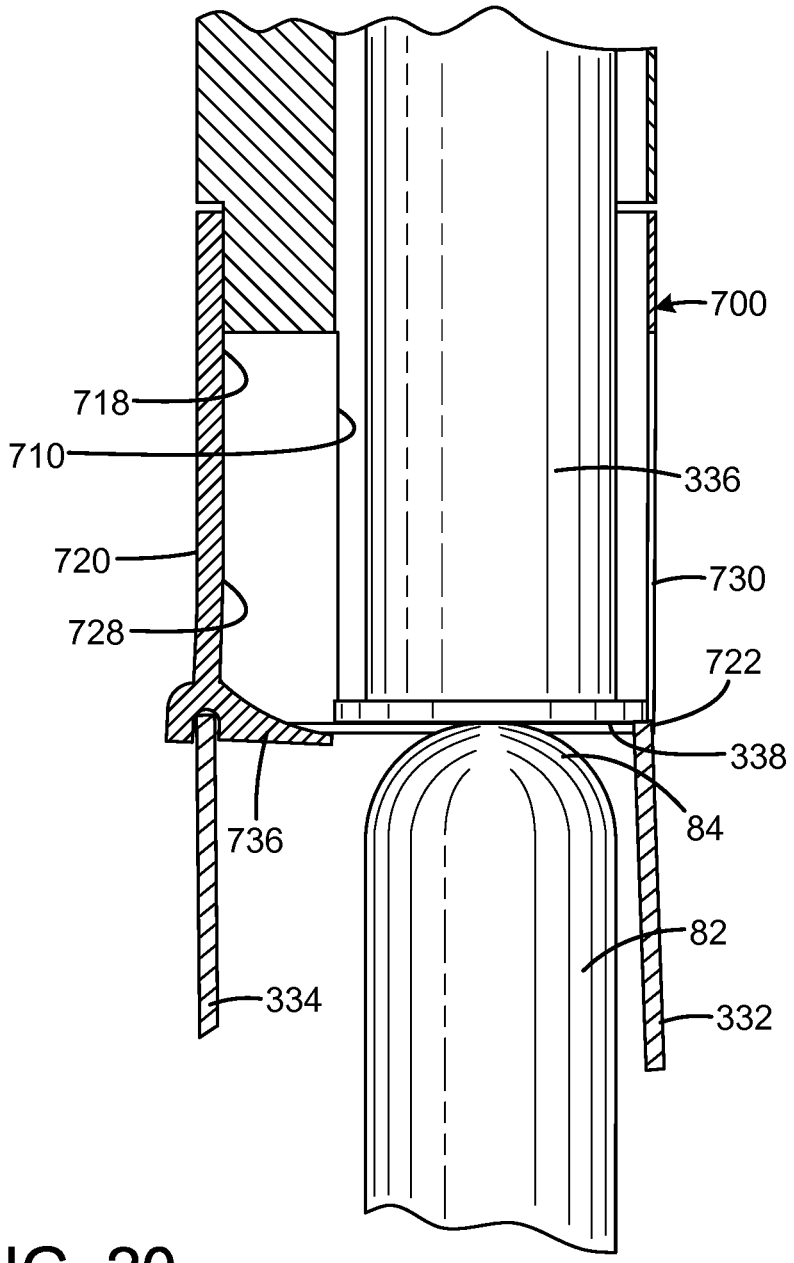
FIG. 20 is a bottom enlarged sectional view of the magazine tube adapter of FIG. 17 with the forend of the shotgun of FIG. 1 in the rearwardmost position with the rearmost cartridge fully pushed onto the shell lifter adapter of FIG. 3.

In FIG. 20, the forend 68 is still fully retracted into the rearmost position. The right magazine tube interrupter 334 has pulled the right interrupter 720 outwardly, thereby disengaging the right interrupter from the rear 86 of the rearmost cartridge 82. Disengagement of the right interrupter from the rear of the rearmost cartridge has permitted the magazine tube spring with follower 36 to push the rearmost cartridge rearward fully out of the magazine tube adapter 700 and onto the shell lifter adapter 100 on the shell lifter 50. The magazine tube spring with follower has also pushed the rear 338 of the next cartridge 340 into engagement with the left magazine tube interrupter 332.

Figure 21:
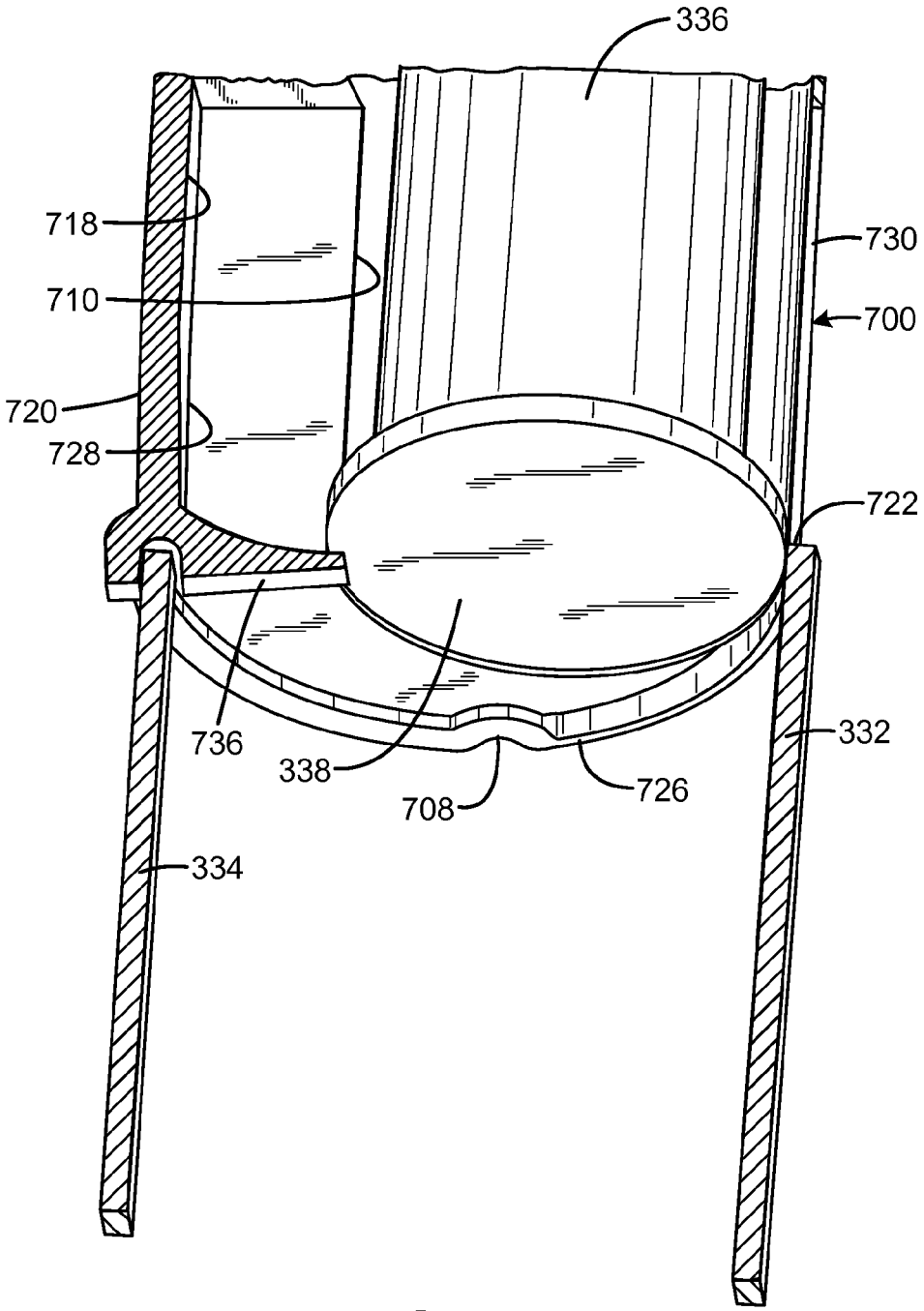
FIG. 21 is a bottom enlarged sectional view of the magazine tube adapter of FIG. 17 with the forend of the shotgun of FIG. 1 returned to the forwardmost position.
Figure 22:
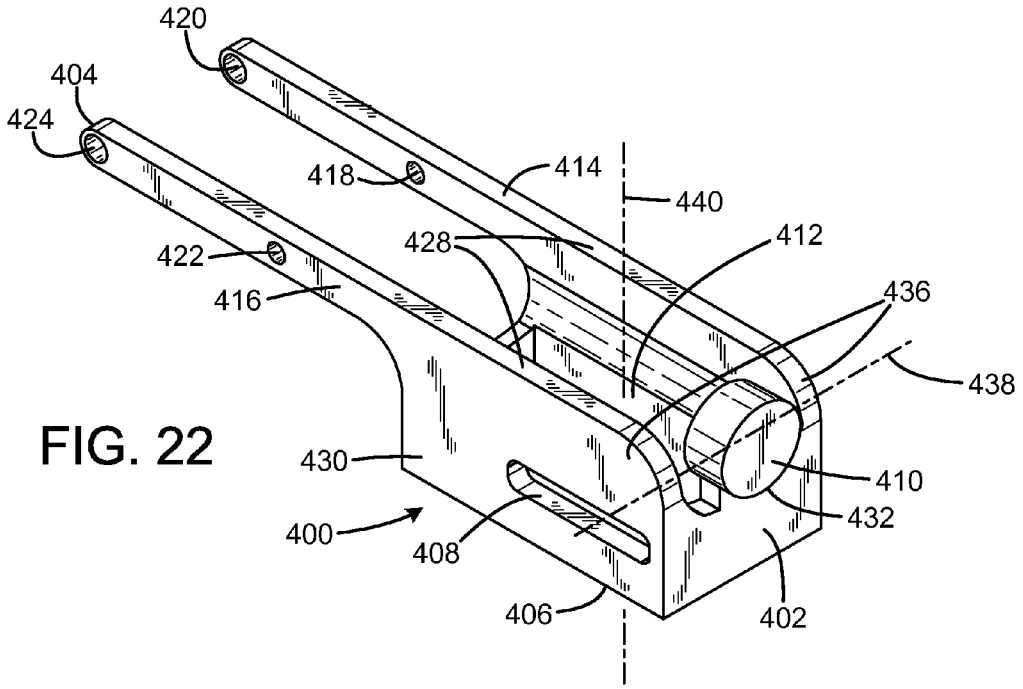
FIG. 22 is a top isometric view of a current embodiment of the magazine adapter of the present invention.
Figure 23:
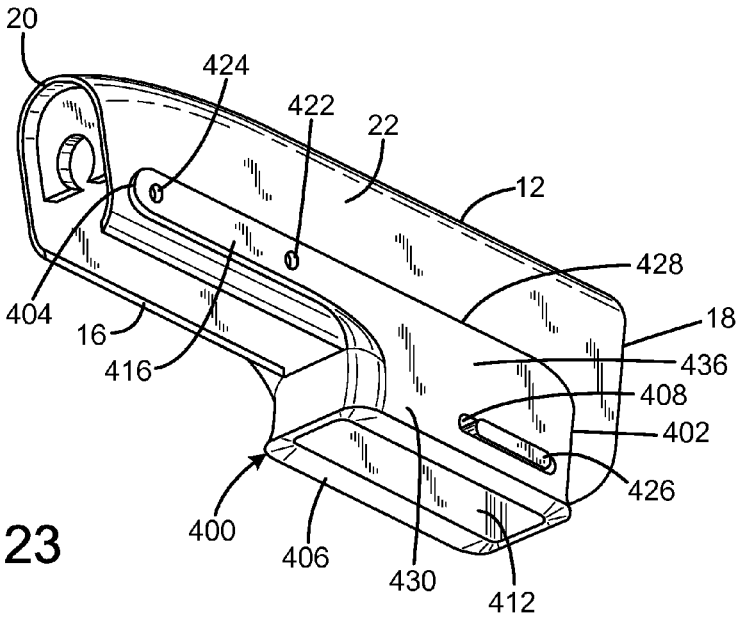
FIG. 23 is a bottom isometric view of the magazine adapter of FIG. 22 installed on the receiver of the shotgun of FIG. 1.
Figure 24:
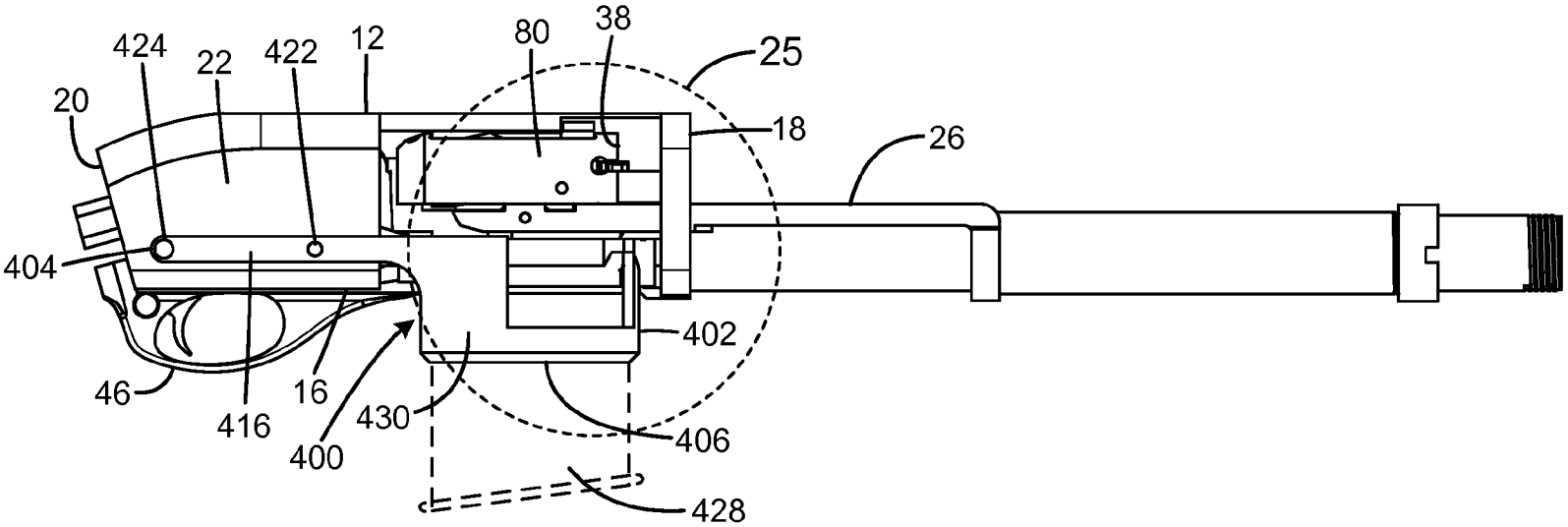
FIG. 24 is a right side sectional view of the magazine adapter of FIG. 22 installed on the receiver of the shotgun of FIG. 1.

In FIG. 21, the forend 68 has returned to the forwardmost position depicted in FIG. 18. The left magazine tube interrupter 332 has moved outwardly to disengage from the rear 338 of the next cartridge 340. Simultaneously, the right magazine tube interrupter 334 has pulled the right interrupter 720 inwardly so the next cartridge 340 is retained within the asymmetrical bore 310 of the magazine tube adapter by the inward protrusion 736 on the right interrupter. As the interrupters move, the magazine tube spring with follower 36 urges the next cartridge rearwardly once the left interrupter has disengaged from the rear of the next cartridge. The cycle can then repeat.

Figure 25:
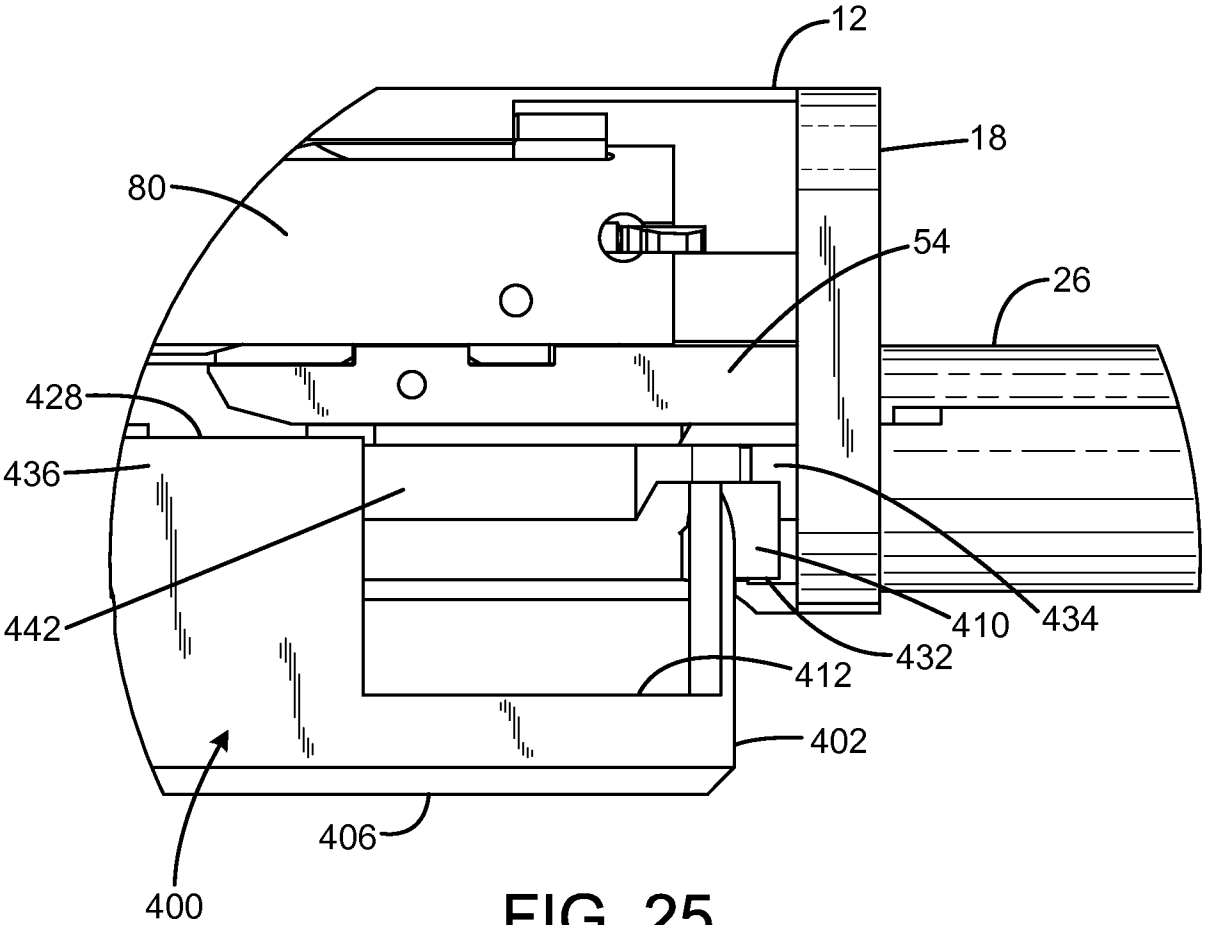
FIG. 25 is an enlarged sectional view taken along line 25 of FIG. 24.

FIGS. 22-25 illustrate the magazine adapter 400 of the present invention. More particularly, the magazine adapter enables the shotgun 10 to feed ammunition from a detachable box magazine 428 (shown in FIG. 24) instead of the magazine tube 26. The magazine adapter has a front 402, rear 404, and bottom 406. The front has a sleeve 430 that defines a magazine well 412. A cylindrical boss 410 extends forward of the sleeve at a level above at least a portion of the sleeve. The boss defines a horizontal axis 438 that is perpendicular to a vertical axis 440 defined by the sleeve. The boss extends forward of a left tang 414 and a right tang 416 that extend rearwardly from opposed side panels 436 that extend above the sleeve. The left tang has apertures 418, 420, and the right tang has apertures 422, 424. One side of the magazine adapter defines a magazine latch slot 408. The magazine latch slot receives a magazine latch 426 that releasably secures the magazine within the magazine well. The magazine passes between the action bars (action bar 442 is shown in FIG. 25) of the forend 68 when the magazine is received by the magazine well. In the current embodiment, the boss is made of plastic or aluminum, and the magazine well is rectangular.

The two opposed side panels 436 of the magazine adapter 400 that extend above the sleeve 430 are spaced apart to closely receive the bottom 16 portion of the receiver 12. An upper surface portion 428 of the opposed side panels contacts the bottom of the receiver to enclose the loading port 40 with the magazine well 412 axially registered with the loading port. First, the shell lifter 50 is removed from the receiver or trigger group assembly. Subsequently, the boss 410 is inserted into the rear aperture of the magazine tube 26 to releasably retain the front of the magazine adapter via contact of a lower cylindrical surface portion with a lower portion of the magazine tube adjacent to the rear aperture. The cylindrical boss has a diameter sized to be closely received in the magazine tube. The left and right tangs 414, 416 are then positioned on the right and left sides 22, 24 of the receiver so that the apertures 418, 420, 422, 424 are axially registered with the takedown pin apertures 42. The takedown pins 44 are replaced with longer cylindrical pins or threaded bolts (not shown) to removably secure the rear 404 of magazine adapter to the receiver.

In the configuration depicted in FIG. 22-25, the magazine adapter 400 enables 12 gauge shotgun shells to be fed from a detachable box magazine 428 into the shotgun 10. However, it should also be appreciated that when the appropriate bolt assembly 200 and barrel 500 of the current invention are also installed, any suitable rifle cartridge can be fed from a suitable detachable box magazine into the shotgun 10.

While current embodiments of a shotgun ammunition conversion system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the shotgun ammunition conversion system of the current invention works with any repeating action shotgun such as semi-automatic, automatic, and lever action, in addition to the pump action shotgun described. Furthermore, the cylindrical boss could be any suitable shape that fits the magazine tube, including hexagonal, octagonal, and semi-cylindrical. The critical surface is the bottom of the boss. Any shape that provides at least two points of contact in the lower half of the boss, to provide against the front end being lowered from its position or shifted laterally, is suitable.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A detachable magazine well for a shotgun having a frame defining a lower loading port, and a magazine tube having a rear aperture proximate the loading port, the magazine well comprising:

a sleeve defining a rectangular passage adapted to removably receive an ammunition magazine;

a boss extending forward of the sleeve and at a level above at least a portion of the sleeve;

the boss being adapted to be received in the rear aperture of the magazine tube;

the boss being adapted for securing a forward end of the magazine well to the shotgun frame; and a first panel extending from the sleeve and defining a panel aperture operable to receive a fastener associated with the shotgun frame to secure the magazine well to the shotgun with the sleeve proximate and aligned with the loading port when the boss is received in the rear aperture of the magazine tube.

2. The magazine well of claim 1 wherein the boss has a lower cylindrical surface portion operable to contact a lower portion of the magazine tube adjacent to the rear aperture.

3. The magazine well of claim 1 wherein the boss is a cylindrical body.

4. The magazine well of claim 3 wherein the cylindrical body has a diameter sized to be closely received in the magazine tube.

5. The magazine well of claim 3 wherein the cylindrical body defines a horizontal axis perpendicular to an axis defined by the sleeve.

6. The magazine well of claim 1 wherein the sleeve includes an upper surface portion operable to contact a lower portion of the frame to enclose the loading port.

7. The magazine well of claim 1 including opposed side panels extending above the sleeve and spaced apart to closely receive a portion of the frame.

8. The magazine well of claim 7 including a tang extending rearwardly from at least one of the side panels.

9. The magazine well of claim 1 including opposed tangs extending rearwardly from the sleeve and spaced apart to closely receive a portion of the frame.

10. The magazine well of claim 9 wherein the tangs each define a tang aperture located to register with a frame aperture on the frame, and including a fastener received in the tang apertures and frame aperture.

11. The magazine well of claim 10 wherein the fastener is a cylindrical pin.

12. The magazine well of claim 1 wherein the magazine well has a major side surface defining a major plane, and wherein the panel is parallel to the major plane.

13. The magazine well of claim 1 wherein the panel occupies a vertical plane.

14. The magazine well of claim 1 wherein the boss is unitary with the sleeve.

15. The magazine well of claim 1 wherein the shotgun frame defines a transverse aperture receiving a horizontal pin, and wherein the panel aperture is registered with the transverse aperture.

16. The magazine well of claim 1 wherein the sleeve defines a major sleeve axis providing a vertical extraction direction, and wherein the panel aperture defines a panel aperture axis perpendicular to the sleeve axis.

17. The magazine well of claim 1 wherein the panel aperture spaced apart rearward of the boss.

18. A method of attaching the magazine well of claim 1 to the shotgun comprising:

positioning the boss in the rear aperture of the magazine tube;

registering the sleeve with the loading port;

aligning the tang aperture with a frame aperture defined by the frame; and inserting a fastener into the tang aperture and the frame aperture.

19. A detachable magazine well for a shotgun having a frame defining a lower loading port providing communication with an internal space, opposed parallel sidewalls defining transverse apertures, and a magazine tube having a rear aperture proximate the loading port, the magazine well comprising:

a sleeve defining a rectangular passage adapted to removably receive an ammunition magazine;

a boss extending forward of the sleeve and at a level above at least a portion of the sleeve;

the boss being adapted to be received within the internal space of the frame in the rear aperture of the magazine tube;

the boss being adapted for securing a forward end of the magazine well to the shotgun frame;

the sleeve being adapted to be secured externally of the internal space;

an intermediate connection portion connecting the boss to the sleeve and passing through the loading port;

opposed first and second panels extending from the sleeve and spaced apart to abut respective sidewalls of the frame to closely receive the frame therebetween; and at least one of the first and second panels defining a panel aperture registered with the transverse aperture and operable to receive a fastener occupying the transverse aperture.

* * * * *